US005667438A

United States Patent [19]

Rehm

[11] Patent Number: 5,667,438

[45] Date of Patent: Sep. 16, 1997

[54] METHOD OF CONSTRUCTING CROSSWORD PUZZLES BY COMPUTER

[76] Inventor: Peter H. Rehm, 14245 Les Palms Cir. #2, Tampa, Fla. 33613

[21] Appl. No.: 359,333

[22] Filed: Dec. 19, 1994

Related U.S. Application Data

[63] Continuation of Ser. No. 51,985, Apr. 22, 1993, abandoned.

[51] Int. Cl.[6] ..... A63F 9/24

[52] U.S. Cl. ..... 463/9

[58] Field of Search ..... 463/9, 1; 273/153 R, 273/156, 240, 433, 85 G; 434/169, 177, 307 R, 323; 364/419.01, 419.04

[56] References Cited

U.S. PATENT DOCUMENTS 4,369,973 1/1983 D'Aurora et al. ..... 273/153 R

OTHER PUBLICATIONS

Ginsberg, Matthew L., et al, "Search Lessons Learned from Crossword Puzzles," *Proceedings of AAAI,* 1990, pp. 210–215.

Berghel, H, "Crossword Compilation with Horn Clauses," *The Computer Journal,* vol. 30, No. 2, 1987, pp. 183–188.

Berghel, H, et al, "Crossword Compiler–Compilation", *The Computer Journal,* vol. 32, No. 3, 1989, pp. 276–280.

Harris, G. H., et al, "Dynamic Crossword Slot Table Implementation", Proceedings of the 1992 ACM/SUGAPP Symposium on Applied Computing, vol. 1, 1992, pp. 95–98.

Mazlack, Lawrence J., "Machine Selection of Elements in Crossword Puzzles," *Siam J. on Computing,* vol. 5, No. 1 (1976) pp. 51–72.

Mazlack, Lawrence J., "Computer Construction of Crossword Puzzles Using Precedance Relationships", *Artificial Intelligence,* vol. 7, No. 1 (1976), pp. 1–19.

Smith, P.D., and Steen, Y., "A Prototype Crossword Compiler", *The Computer Journal,* May 1981, pp. 107–111.

Albert, Eric, "Crosswords by Computer," *Games,* Feb. 1992, pp. 10–13 (see also pp. 35–37, 40).

Centron, "Crossword Creater—Win", 1993 (all pages).

"Crossword Creator—Win Manual" by Centron pp. 4–15.

RDA/mind builders, "Educational Power Tool." pp. 5–17.

XENO: Computer–Assisted Compilation of Crossword Puzzles by P.D. Smith pp. 296–302, Nov. 1983.

"Creating Crosswords (using Wordperfect 5.1 . . . )" by Thornton, Susan, WordPerfect Magazine, Feb. 1992 p. 46.

"Computerized Crosswords Come of Age" by Schwartz, v. Computer Shopper, Mar. 1993 p. 580.

"Crossword Software Generates Puzzles for Enjoyment or Education" by Trivette, D., PC Magazine May, 1991 p. 478.

"Mickey's Crossword Puzzle Maker". by Parham, C. Technology & Learning Mar. 1991, p. 9.

*Primary Examiner*—Jessica Harrison
*Assistant Examiner*—Michael O'Neill
*Attorney, Agent, or Firm*—Peter H. Rehm

[57] ABSTRACT

A software crossword puzzle design tool is provided. It provides a menu-driven user interface with various editing functions allowing the user to specify details of the crossword puzzle desired, such as the size, pattern, and inclusion of certain theme words. The unsolved puzzle is constructed automatically by a computer assigning letters to cells one cell at a time. After each assignment, the affected wordslots are compared to a lexicon of words to determine what letters of the alphabet may potentially be assigned to each of the remaining unassigned cells. If any unassigned cell becomes unassignable, some assignments must be reversed and others tried. Special data structures for the lexicon and fast methods of accessing the lexicon are disclosed. Clues can be assigned to the puzzle automatically or manually, and then the unsolved puzzle can be printed.

7 Claims, 15 Drawing Sheets

Microfiche Appendix Included
(2 Microfiche, 185 Pages)

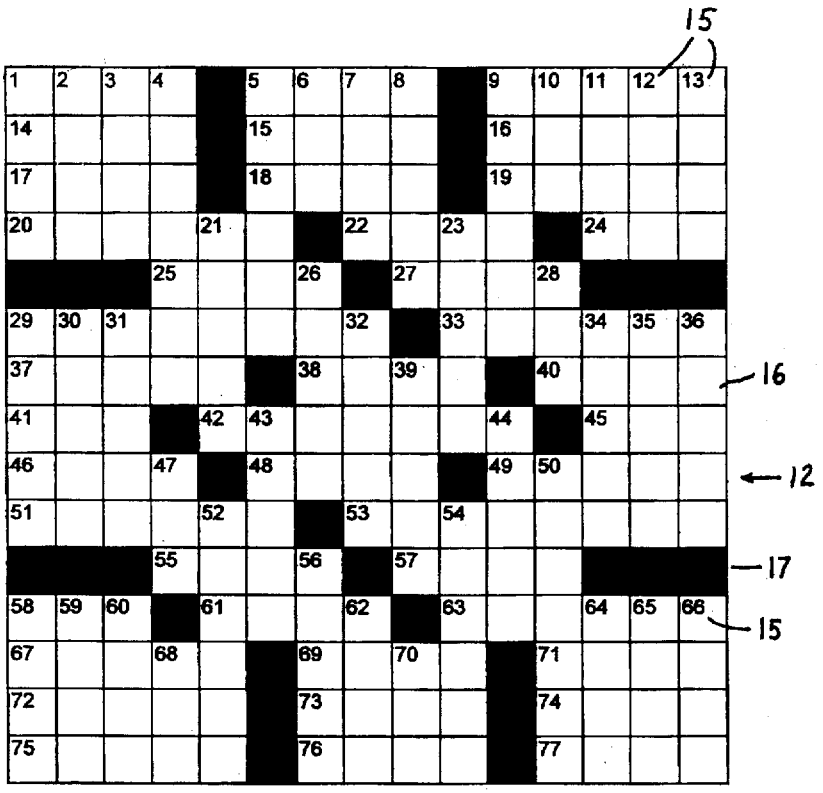

Fig. 1

ACROSS

1 Hook
5 Cougar
9 Lean
13 14 Absent
15 Consumer
16 Eagle's nest
17 Sensitive; tender
18 Despot
19 Camels backs
20 Network of nerves
22 Space
24 Concord jet
25 Scratch
27 Energetic
29 Ironed
33 Increases
37 Baseball pitcher Leroy
38 Locations
40 Fringe benefit
41 Every
42 NC capital
45 Green legume
46 Branch
48 Articulate; formulate
49 Decree
51 Boat parking lot
53 Divide
55 Course
57 Wander
58 Greek letter
61 Siamese
63 Artisan; craftsman
67 Shining
69 In the same place
71 Birthmark
72 Island
73 Flying toy
74 Additional; more
75 Trade
76 Former nation
77 Title

DOWN

1 Breathe; pant
2 Absent
3 Forward
4 Change of shape; bend
5 Coup d'etat
6 Part of ship's name
7 Intend
8 Tapestry
9 Desert
10 Monetary unit
11 Weapons
12 Blights
13 Examine
21 Say
23 Small shoot or twig
26 Greeting
28 Small dog's biggest bark
29 Cramp
30 Island nation
31 Oil tanker
32 Those who do
34 Reddish brown
35 Build
36 Glide
39 Beverage
43 Afloat
44 Lift
47 Center
50 Imagined
52 Dullard
54 Crunch; grind
56 Japanese lyric poem
58 Mineral powder
59 Gum
60 Bone
62 Ciconiiform wading bird
64 Rodent
65 Otherwise
66 Woodwind
68 Klutz
70 Belonging to something

Fig. 1A

| | | | | | | | | | | | | | | |
|---|---|---|---|---|---|---|---|---|---|---|---|---|---|---|
| G | A | F | F | | P | U | M | A | | S | L | A | N | T |
| A | W | O | L | | U | S | E | R | | A | E | R | I | E |
| S | O | R | E | | T | S | A | R | | H | U | M | P | S |
| P | L | E | X | U | S | | N | A | S | A | | S | S | T |
| | | | I | T | C | H | | S | P | R | Y | | | |
| S | M | O | O | T | H | E | D | | R | A | I | S | E | S |
| P | A | I | N | E | | L | O | C | I | | P | E | R | K |
| A | L | L | | R | A | L | E | I | G | H | | P | E | A |
| S | T | E | M | | W | O | R | D | | E | D | I | C | T |
| M | A | R | I | N | A | | S | E | P | A | R | A | T | E |
| | | | D | I | S | H | | R | O | V | E | | | |
| T | A | U | | T | H | A | I | | W | E | A | V | E | R |
| A | G | L | O | W | | I | B | I | D | | M | O | L | E |
| L | A | N | A | I | | K | I | T | E | | E | L | S | E |
| C | R | A | F | T | | U | S | S | R | | D | E | E | D |

19

METHOD OF CONSTRUCTING CROSSWORD PUZZLES BY COMPUTER

CROSSWORD PUZZLES BY COMPUTER

This application is a continuation of Ser. No. 08/051,985, filed Apr. 22, 1993, which is now abandoned.

This patent disclosure includes an appendix consisting of two microfiche having a total of 185 frames.

A portion of the disclosure of this patent document contains material which is subject to copyright protection. The copyright owner has no objection to the facsimile reproduction by anyone of the patent document or patent disclosure, as it appears in the Patent and Trademark Office patent files or records, but otherwise reserves all copyright rights whatsoever.

BACKGROUND OF THE INVENTION

This invention relates generally to computer processes and specifically to a method by which a person unskilled in crossword puzzle construction can use a computer to construct custom crossword puzzles.

FIG. 1 shows a crossword puzzle 10 having particular characteristics important to the invention. The crossword puzzle 10 includes an unsolved crossword puzzle grid 12 and a list of clues 14 or definitions. The solution 19 is shown in FIG. 1A. This crossword puzzle 10 and its solution 19 were made with use of the process herein disclosed. In general, this is the type of puzzle that appears in newspapers and magazines. It has several characteristics that distinguish it from other types of crossword puzzles. It is usually made of words that are at least three letters long. It has many empty cells 16 (the small squares) that are capable of receiving a letter and relatively few blocked out cells 17. Most importantly, all of the empty cells 16 are crossed, meaning that they are in two crossing words. This means none of the cells 16 that are to receive a letter are "blind." This is very important because a puzzle solvers frequently must figure out a difficult word by doing some intersecting words first. The type of crossword puzzle in which every cell is a member of two intersecting words will be referred to herein as "fully-crossed."

If the puzzle is substantially fully-crossed but there are a few blind cells that are members of only one word, then the puzzle will be called "tightly-crossed." Use of a tightly-crossed puzzle might be excused when the pattern of blocked cells is supposed to express a particular image that cannot be portrayed by a fully-crossed pattern. An example is a pattern having four diagonal "ladders" of blocked squares in the shape of a baseball diamond. This pattern has four blind cells, one to the inside of each of the four "bases." It is acceptable because it is not done to simplify puzzle construction but to help convey a baseball theme. Thus, while it is useful for a program to be capable of making tightly-crossed puzzles, the real goal is usually a fully-crossed puzzle.

It is very difficult to make a fully-crossed puzzles with words of non-trivial length. Relatively few people have the skill to make such a puzzle, even when no particular words must appear in it. The task is even more difficult when the puzzle constructor wants certain words in the puzzle.

Another kind of crossword puzzle, herein called a "loosely-crossed" crossword puzzle, is not the subject of the invention and is mentioned here to distinguish it. These puzzles are easy to make. They can be constructed exclusively of preselected theme words, using no "glue" words to tie the puzzle into a single whole. Additional words usually can be added as desired without difficulty. These puzzles tend to have irregular patterns with lots of open space in them. They have fewer words for the space they occupy. Most importantly, only a few of the cells are crossed with another word. This means the words contain many blind cells. Blind cells are undesirable because the puzzle solver has only one way to figure out the letter, and that is to identify the word itself from that word's clue. If stuck, he or she cannot determine the letter by turning to the clue for a perpendicularly intersecting word.

The difference between these two kinds of crossword puzzles can be thought of as the difference between the abilities of a skilled crossword puzzle constructor, one who has invested a great deal of time developing this talent, and the ordinary person, which includes most crossword puzzle solvers. A fully-crossed crossword puzzle also has greater aesthetic appeal.

Computer software for designing crossword puzzles takes on several forms. First is software that allows a person to design a crossword puzzle using his own crossword construction skills. This type of software replaces a pencil and paper. The constructor manually creates an intersecting arrangement of words on a computer monitor. It helps the constructor like a word processor helps the writer. Sometimes tools might be provided to find such things as all five letter words ending in "ED". The extreme difficulty of designing publication-quality crossword puzzles even with a tool like this limits the usefulness of such a program.

A second type of crossword construction software takes a more active roll. The user enters a list of words that he wants to appear in a crossword puzzle. The program then assembles these words into a loosely-crossed crossword puzzle. A loosely-crossed crossword puzzle is one that has relatively few words and most of the letters in the words are not crossed (or keyed) by perpendicular words. There are also lots of blocked or blank spaces instead of cells.

These crossword programs must be carefully scrutinized to be classified. It is common practice for an advertisement of a software product to say that you can use it to create crossword puzzles for profit by selling them to newspapers and magazines. The reality is that you either have to be an expert designer or find a magazine willing to publish a loosely-crossed puzzle, because the advertised product can not create fully- or tightly-crossed crossword puzzles automatically.

OBJECTS AND SUMMARY OF THE INVENTION

The objects of the invention are to provide a software product that enables a person untrained in crossword construction to design and produce a custom publication-quality crossword puzzle, characterized by being fully crossed or tightly-crossed and incorporating a number of user-specified theme words in either specified and/or unspecified locations. Another object is for the program to operate reasonably quickly. A further object is for the software to be easy to learn and use.

These and other objects are fulfilled by providing a crossword construction program with a menu bar and pull-down menus. A display shows the puzzle under construction. An edit mode allows the user to assign letters or spaces to the cells. The cursor can be set to advance either across or down after each is letter typed. The letters that are typed in become part of the puzzle to be constructed, or portions of the constructed puzzle can be erased.

The user can select a pattern from a number of prepared patterns, or create his or her own. The cells can be changed from blocked to unblocked state at will, either individually or in symmetric groups. Special pattern manipulation functions are provided to flip the pattern vertically or horizontally or to rotate it 90 degrees. Another function is provided to exchange the down-oriented word with the across-oriented words for easier review of the former.

A function is provided to automatically construct the puzzles. This means filling in all the empty and incomplete wordslots with glue words. Wordslots are the positions in the crossword pattern into which a word is to be placed. Glue words are answer words in the puzzle grid that were chosen by the computer, not by the user.

According to the invention, crossword construction is accomplished by performing the following steps: An analysis is performed in which the word fragments (incomplete words) of the puzzle under construction are compared to a lexicon of potential glue words. The result of this analysis is the determination of a set of letters for each empty (unassigned) cell. Each empty cell's set of letters show which letters of the alphabet are still candidates for assignment to that cell. The set of letters are not assigned to the cell; rather, the set of letters only shows which letters of the alphabet have not been ruled out for possible assignment to the cell, according to the current state of the wordslot(s) of which the cell is a member.

If all the unassigned cells in the puzzle have at least one letter in their sets of letters, then a cell is selected and a letter from this cell's set of letters is selected for assignment to that cell. If any empty cell is found to have an empty set of letters, then previous assignments must be undone until this situation is resolved. Whenever assignments are changed, the affected wordslots are reanalyzed to keep the sets of letters current.

Complex rules govern the choice of cell to assign next. These rules tend to result in puzzle construction by gradual progression from one cluster of cells to the next.

The lexicon is stored in one of several special data structures that are conducive to fast analysis to determine the sets of letters. Special methods are used to perform the analysis efficiently.

Provisions are made for the automatic placement of priority theme word. Provisions are also made allowing the user to reject undesired glue words that come up and automatically repair the puzzle after its removal.

After construction is completed, the user can assign clues (also known as definitions) to the answer words in the puzzle grid. This can be done automatically from a database of clues or manually or a combination of the two. Then the user can print the unsolved puzzle, the clues keyed to the unsolved puzzle by box number, and the solution.

BRIEF DESCRIPTION OF THE DRAWING(S)

FIG. 1 shows an illustrative example of a fully-crossed unsolved crossword puzzle that was constructed using the invention.

FIG. 1A shows the solution to the puzzle of FIG. 1.

DESCRIPTION OF THE PREFERRED EMBODIMENT(S)

Figure 2:
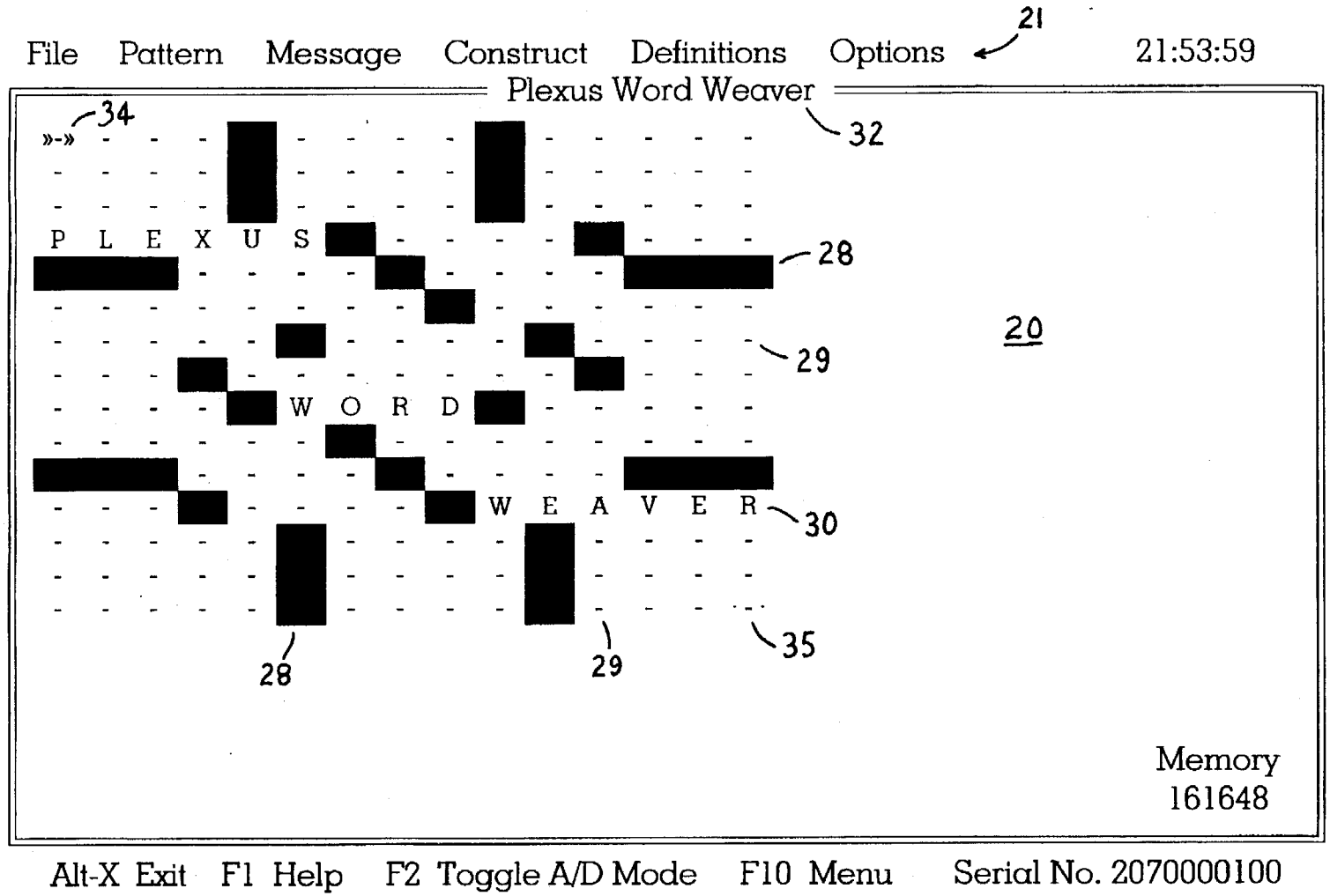
FIGS. 2 shows the main user interface screen.

This invention relates to computer software that enables ordinary computer literate persons to create fully-crossed crossword puzzles, including fully-crossed crossword puzzles with preselected theme words in them. It also enable them to construct crossword puzzles that are tightly-crossed. The software can execute on a computer that has a processor and enough memory to store the various data structures disclosed below, or at least store them in memory at the time they are required. An ordinary personal computer such as an IBM PC or compatible with 640K of RAM memory is more than enough, but the invention can put even more memory to good use. The computer should have input and output capabilities such as a keyboard or mouse and a display screen or printer.

The invention has two main parts, a user interface and a crossword construction engine. It is with the user interface that the user specifies what he wants the puzzle to be like. The user then indicates that the construction engine should be activated. The construction engine attempts to build or construct the puzzle. It selects words to place into the puzzle from a prepared list of words called a lexicon. The words it automatically selects and places into the puzzle are called glue words. When it finishes (whether successful or not) or is interrupted, control is returned to the user interface.

The User Interface

The user interface is an event-driven pull-down menu program. It presents a general environment not unlike the environments of modern word processors, database managers and spreadsheet programs, except of course that it provides a combination of features useful for constructing crossword puzzles. It can be provided as either a character oriented or a graphical user interface, or both. Software tools performing many of the common functions is available in various "application frameworks." Application frameworks typically includes generic routines that display and manipulate a menu bar and pull down menus, dialog boxes, process mouse motion and mouse button clicks, change mouse characteristics and change display colors. The computer language C++ and an application framework called Turbo-Vision by Borland International Inc were used for the user interface disclosed herein. However, the computer-implemented process can be expressed in many other computer languages and with many other application frameworks or no application framework.

The user interface allows the user to open (retrieve) and save data files. These data files contain descriptions of crossword puzzles at any stage of development. The user interface also provides a way to specify crossword puzzle grid dimensions. It provides a way to select and/or edit the pattern of blocked cells and place and remove letters in particular cells as desired. It provides global grid manipulation functions, ways to select modes of operation, ways to reject certain words, assign and edit clues, and to print the puzzle and export it to a data file.

With reference to FIG. 2, the main menu is a menu bar 21 situated across the top of the main screen 20 of the user interface. The menu items are arranged in the sequence generally followed to create a puzzle. They are as follows: File is used to create a new file, to specify the dimensions of the grid, or to open an old file. Pattern is used to create a pattern of blocked/open cells or to load a prepare pattern. Message is helpful to enter the message or theme words. Construct is used to tell the program to construct a puzzle around the pattern and message words, if any. Definitions is used to assign definitions to the puzzle. The Options menu is used to customize mouse operation and screen colors.

Figure 3:
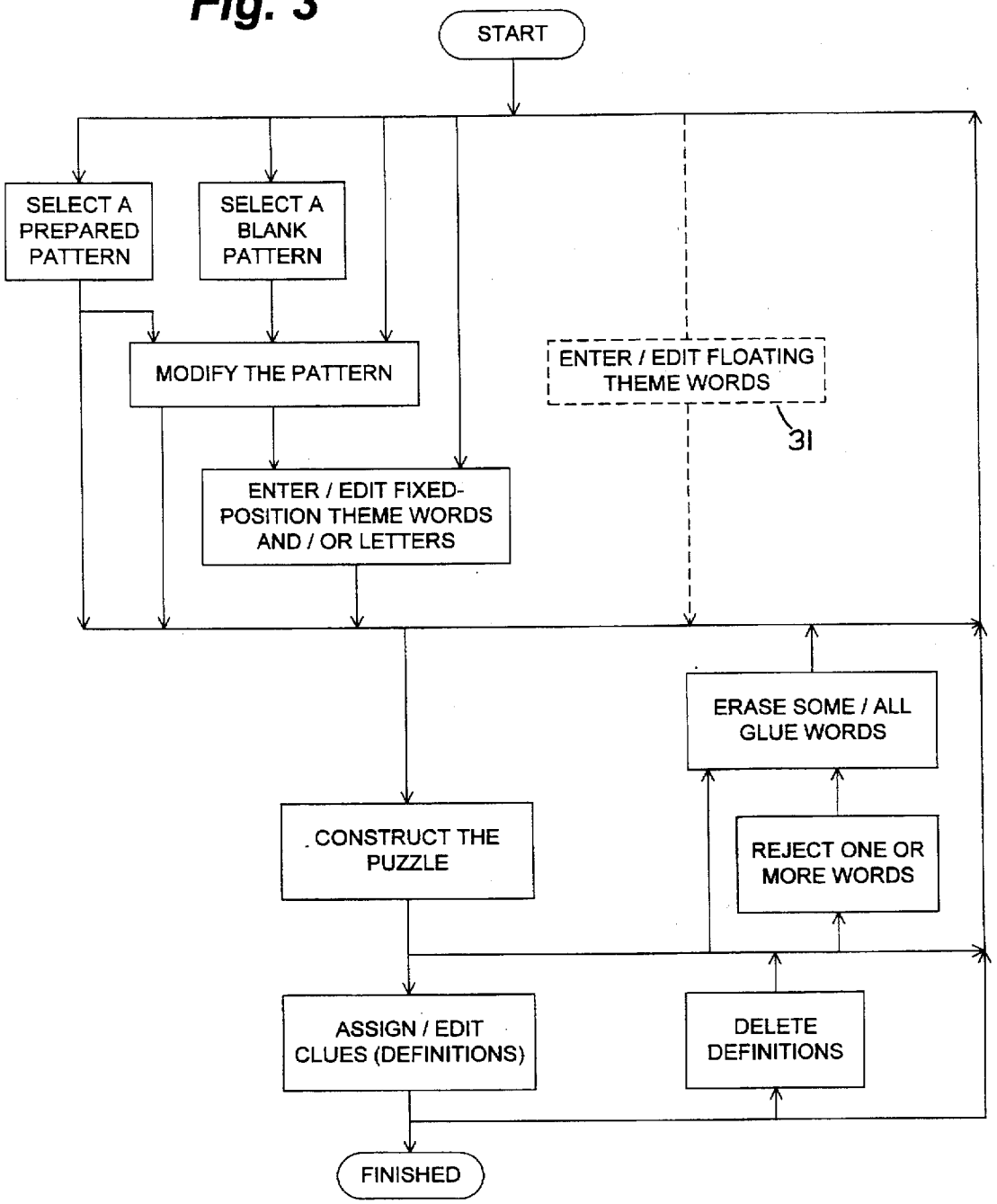
FIG. 3 is a flowchart of the major steps the user of the invention may follow to design a crossword puzzle.

This sequence is not binding; users will typically go back and forth as their ideas and creativity direct. FIG. 3 is a flowchart showing generally some of user's options in creating a puzzle. (The box for floating theme words 31 is provided according a preferred embodiment that was not yet implemented and does not appear on the menu but is taught below.) The unsolved puzzle, clues and solution can be saved to disk or printed at any point in the flowchart, whether or not the puzzle is finished.

Normally, the user interface is in edit mode. FIG. 2 shows this mode. In edit mode the computer monitor displays a representation of a crossword puzzle under development. Each cell of the puzzle is either blocked 28 or unblocked. Unblocked cells are either empty cells (also known as "unassigned cells" or just "cells") or they contain a letter of the alphabet. In a character-oriented user interface, empty cells 29 are indicated by hyphens. FIG. 2 shows a fifteen by fifteen cell puzzle under development with three fixed position theme words 30. Fixed-position theme words are herein sometimes called message words, because they can be deliberately arranged to form a phrase or sentence. In this example, the message is "Plexus Word Weaver," which by coincidence is the name of the software 32.

One cell is highlighted with a cursor 34. The cursor 34 shows which cell will be affected by certain commands. For example, any alphabetic letter that is typed is placed in the cell marked by the cursor. A space removes any letter that may happen to be there, restoring it to an empty (unassigned) cell. After such a cell-altering command is received and processed, the cursor 34 advances to the next cell, usually to the right. A mouse can also move the cursor 34. A click of the mouse button on any cell can move the cursor 34 directly to that cell.

Some of the cells are blocked off so they cannot contain letters. Blocked cells 28 can be changed to unblocked by accessing certain functions on the menu or by the shortcuts Alt+B for block and Alt+U for unblock. ("Alt+B", for example, is a key combination accomplished on an IBM PC by holding down the "Alt" key while pressing the "B" key. Other kinds key combinations may be invented for computers with no Alt key, if this optional feature is desired.) A double-click of a mouse button, or an Alt+T, causes the cell to toggle between blocked and unblocked states.

Usually, crossword puzzle patterns are symmetric about the upper-right to lower-left diagonal. Thus the block, unblock and toggle functions usually operate on two cells at once: the cell indicated by the cursor and another cell indicated by a second, "side effect" cursor 35. The side effect cursor 35 is visible but unobtrusive, so you have to look for it to notice it. A non-directional symbol such as a pair of small dots, one to each side of the letter, makes an acceptable side effect cursor 35.

Editing can take place in either "across mode" or "down mode." When the cursor advances to the "next cell," it moves either one cell to the right or one cell down, depending on its mode. A special, directional cursor is preferred to indicate the current mode with right facing arrows for across (see 34) and downwardly facing arrows for down (see 36 on FIG. 2F). The mode can be changed by accessing the menu, the keys Alt+A for across and Alt+N for down, or a function key to toggle the mode. Alternatively, because crossword puzzles use only upper case letters, the shift key is available to override the normally active across mode. For example, lower case could mean advance as usual for the current mode and upper case could mean advance down regardless of the mode.

The cursor keys, the four keys with arrows pointing up, down, left and right, behave as expected. They move the cursor one cell in the indicated direction. As blocked cells 28 must be accessible too, they are not skipped. Control-left arrow and control-right arrow move to the left and right sides of the grid. Home and end move to the top left and bottom right respectively. Some keys have new meanings. The tab key moves to the first cell of the next across-oriented word slot, scanning from left to right, top row to bottom row.

A variety of global pattern manipulation functions is provided. The most important one by far is the ability to reversibly exchange down words with across words. It is useful for reviewing the down words more easily by temporarily making them across words.

The invention is to be provided with a number of prepared patterns for the user to load at any time and use for constructing a puzzle or as a starting place for making a custom patterns. The prepared pattern also serve as examples of patterns.

Figure 2A:
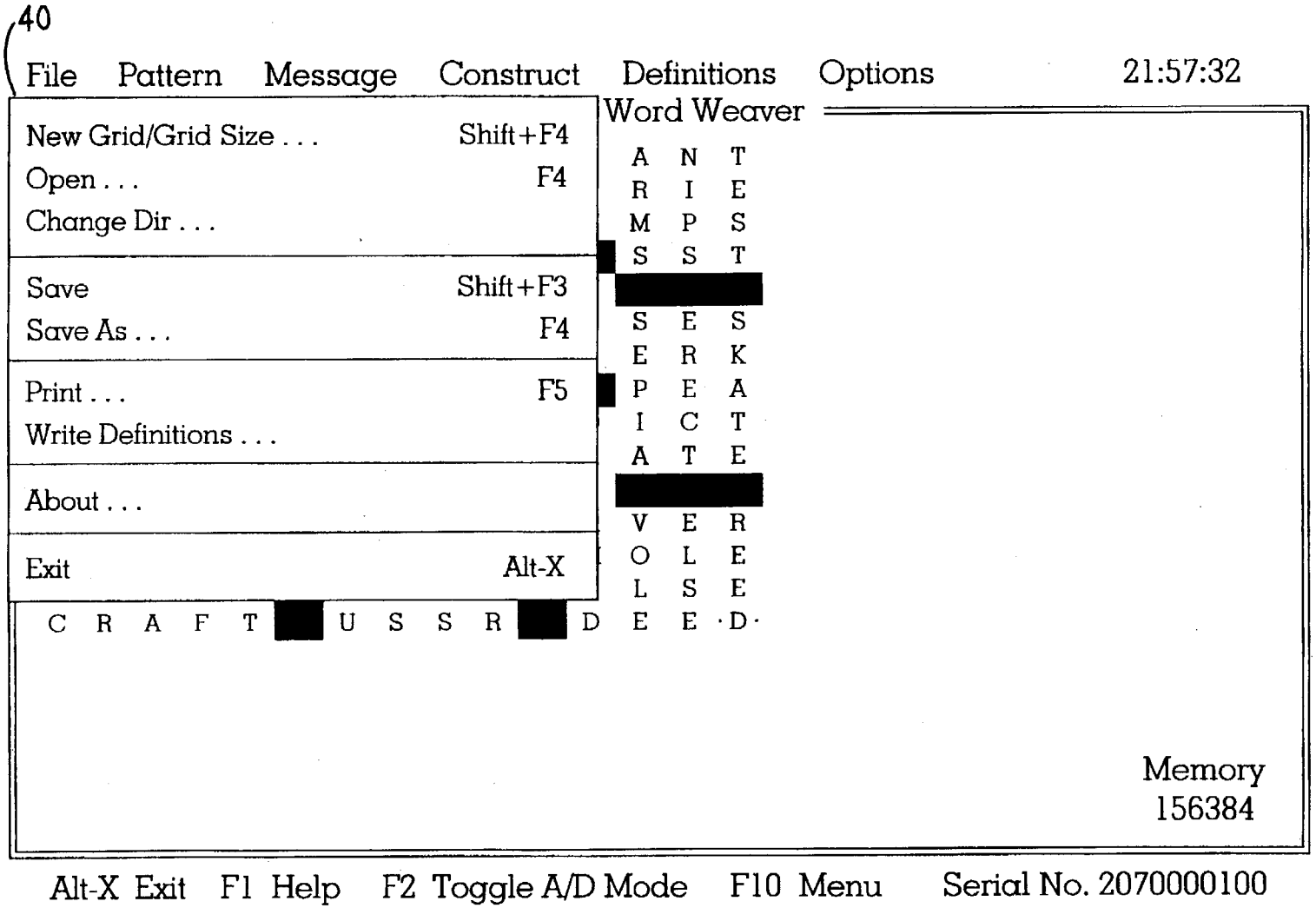
FIGS. 2A through 2F show the user interface with each of the pull-down menus pulled down.

One aspect of the invention is the combination of tools that work together and that are easy to use. The tools are provide in the menu items and shortcuts and also in the edit mode of the program. The following is a tour through the menu:

FIG. 2A shows the "File" pull down menu 40. It provides access to functions affecting the entire file or program execution. Included are commands for starting work on a file, saving it, and printing it, and leaving the program.

The "New Grid/Grid Size . . . " menu item replaces the current grid with a new, patternless grid of user-selectable size. Memory constraints may put an upper limit on the size of a puzzle, such as 17 by 17 cells or 23 by 23 cells. The lower limit should be small, e.g. 2 by 2 cells. Small sizes are useful to the end user for testing printer configurations on slow printers.

The "Open . . . " menu item retrieves a puzzle from a hard or floppy disk.

The "Change Dir . . . " menu item changes the current default directory out of which files are opened and to which files are saved.

The "Save" menu item saves the current puzzle with the name previously assigned. A name is assigned by the latest "Open . . . " or "Save As . . . " command. It assumes permission to overwrite an existing file of the same name. If no name was previously assigned, it works the same as "Save As . . . ", below.

The "Save As . . . " menu item prompts the user for a filename and saves the current puzzle under that name. If the file already exists, it will ask permission to overwrite it. The path names may be given but are not required. The default directory is the directory that was current when the program was started. The default directory can be changed using the "Change Dir . . . " command.

The "Print" menu item prints the crossword puzzle and the solution. Word numbers are assigned automatically. A dialog box is called up that provides the user with the option of changing the dimensions in inches of the unsolved puzzle and solution, printing only certain parts of the puzzle, etc.

The "About . . . " menu item displays the program name, copyright notice and version number.

The "Exit" menu item provides an opportunity to save an unsaved puzzle and then leaves the program.

Figure 2B:
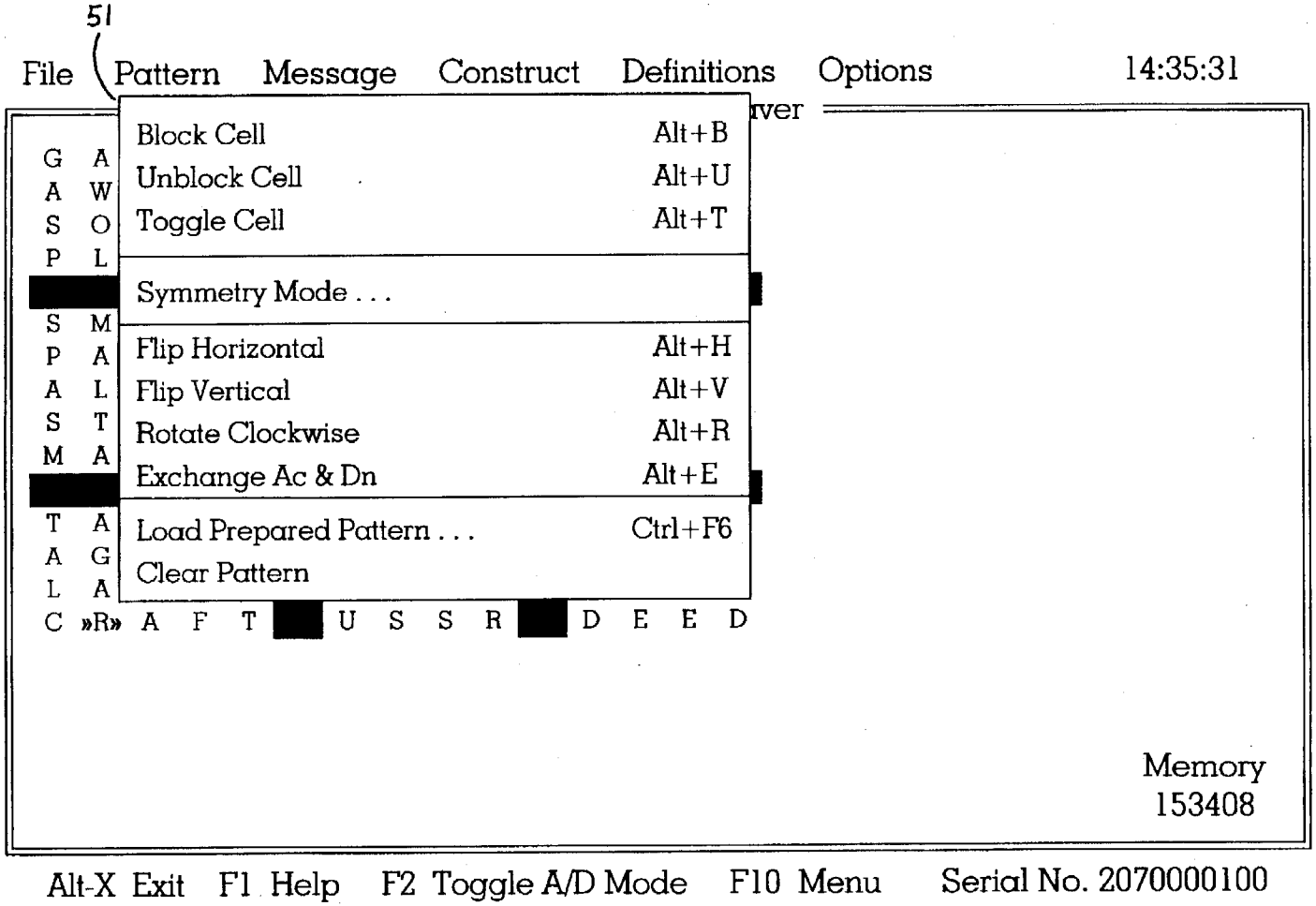

FIG. 2B shows the "Pattern" pull-down menu 51. It provides commands for manipulating the arrangement of blocked and unblocked cells in the puzzle.

The "Block Cell" menu item converts the cell under the cursor to a blocked cell. In the symmetry modes, it also converts the cell(s) under the side-effect cursor(s). Pressing Alt+B is a shortcut.

The "Unblock Cell" menu item converts the cell under the cursor to an empty, unblocked cell. In the symmetry modes, it also converts the cell(s) under the side-effect cursor(s). Pressing Alt+U is a shortcut.

The "Toggle Cell" menu item flips the cell under the cursor from blocked to unblocked or from unblocked to blocked, depending on what it was before. In the symmetry modes, it also flips the cell(s) under the side-effect cursor(s), each action depending on the prior state of the cell in question. Positioning the mouse pointer on a cell and double-clicking the left mouse button performs a Toggle Cell on that cell and its side effect cells, if any. Pressing Alt+T is a shortcut. The "Symmetry Mode . . . " menu item calls up a dialog box that presents three symmetry mode options: No Symmetry, 2-Way Symmetry, and 4-Way Symmetry. The choice of symmetry mode determines the behavior of all blocked cell editing functions above, whether they affect up to one, two or four cells. Changing symmetry mode does not automatically change the current puzzle's pattern. A puzzle's symmetry mode is saved when the file is saved and is restored when the file is opened. The default choice is 2-Way Symmetry. Other variations of symmetry modes are also possible, such as 8-Way and other forms of 4-Way.

The "Flip Horizontal ←→" menu item flips the puzzle from left to right. It is safe for pre-construction patterns and patterns with only a few down-oriented theme words. Across-words end up spelled backwards. A good shortcut is Alt+H.

The "Flip Vertical" menu item flips the puzzle from top to bottom. It is safe for pre-construction patterns and patterns with only a few across-oriented theme words. Down-words end up spelled upsidedown. A good shortcut is Alt+V.

The "Rotate Clockwise" menu item rotates the puzzle 90° clockwise. Two successive rotations clockwise is the same thing as a flip vertical followed by a flip horizontal. Three rotations clockwise equal one rotation 90° counterclockwise. Any multiple of four consecutive rotations cancels itself out. Rotation is safe for pre-construction patterns and patterns with only a few individual letters specified. Message words might end up spelled the wrong way. A good shortcut is Alt+R.

The "Exchange Across & Down" menu item flips the puzzle so across-words read down and down-words read across. This is useful after construction for making the down-words more readable by temporarily making them across-words. A second exchange restores the puzzle to its original state. However, the puzzle can be printed and used in either its original or exchanged state. The words are renumbered after this command. A good shortcut is Alt+E.

The "Load Prepared Pattern . . . " menu item causes a number of prepared patterns to be presented for user selection. The program preferably comes with a number of prepared crossword puzzle patterns, as in separate puzzle files in a "patterns" directory. The prepared patterns are listed by descriptive names of a prominent feature and their size. (e.g., "Diamond.152" for a baseball diamond puzzle, 15 cells across, and 2-way symmetry.) The user can scroll through the list of descriptive names and selectively load any pattern. An improvement would be to display the patterns one by one or several at a time in reduced form. It would also be helpful to present statistics about the patterns as they are shown, namely its dimensions in cells across and down, its symmetry, its total number of wordslots and the number of wordslots for each word size.

The "Clear Pattern" menu item unblocks or erases all cells of the puzzle grid. The grid size and symmetry mode remain unchanged. This is a quick way to get a clean slate for when the user wants to design a pattern from scratch.

Figure 2C:
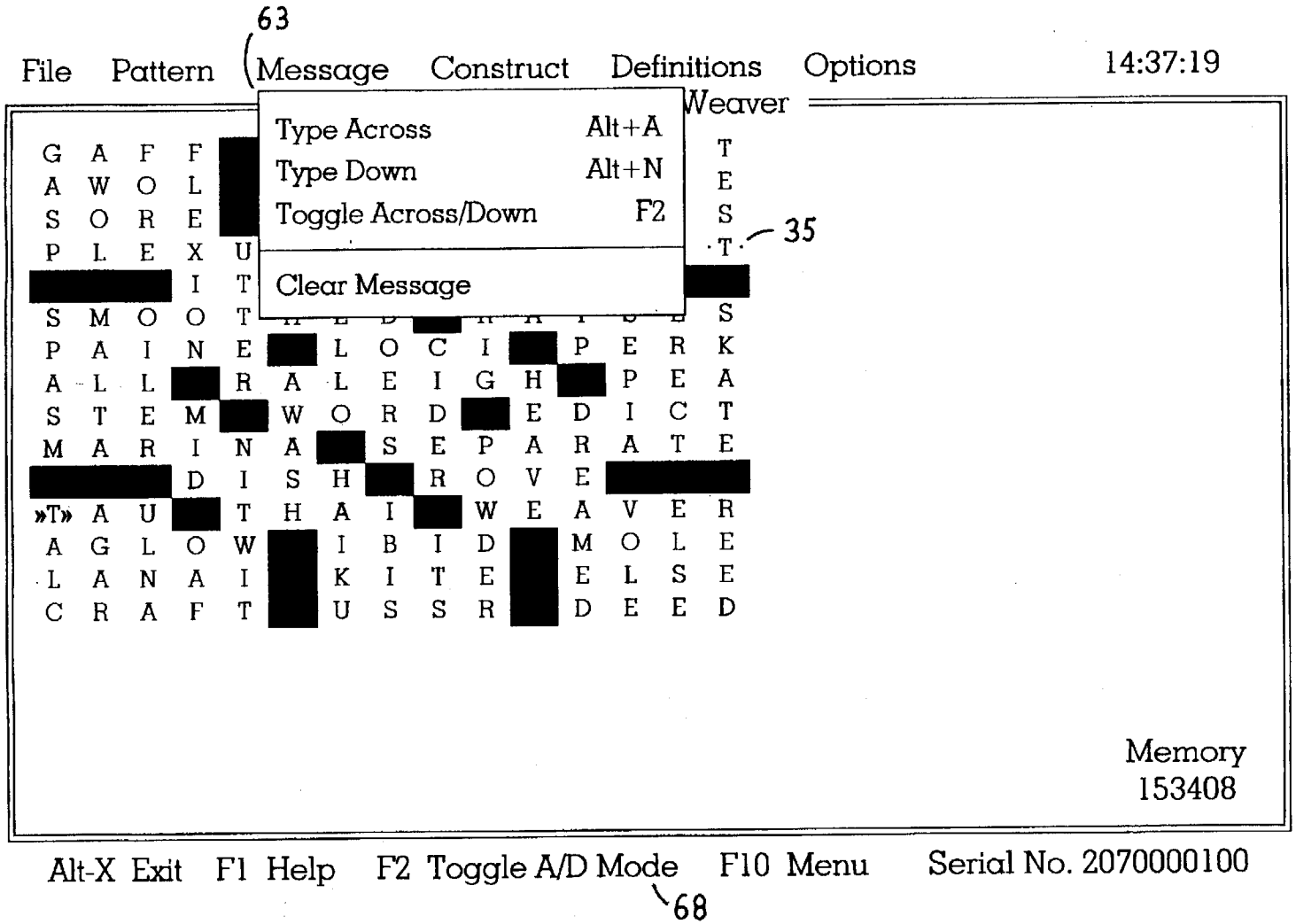

FIG. 2C shows the "Message" pull-down menu 63. It provides certain functions useful while the user enters fixed-position theme words or fixed-position letters into the puzzle grid.

The "Type Across" menu item changes the cursor advance direction (typing direction) back to the normal across mode. A good shortcut is Alt+A.

The "Type Down" menu item changes the cursor advance direction to the down mode. While in this mode, the cursor changes into a pair of arrows pointing down. The user can use this mode to type in down-oriented fixed-position theme words. It is used by positioning the cursor to the first (top) cell where the user wants the down-word. He switches to the down mode and types the word. The cursor advances down one cell with each letter typed. When the cursor hits a blocked cell or the bottom of the grid, the down mode should terminate. The down mode is also useful for use with the block, unblock and toggle cell functions to quickly create columns of blocked cells. A good shortcut is Alt+N.

The "Toggle Across/Down" menu item causes switching between the across and down modes. Because it combines the above two commands in one function, it is particularly useful when provided as a one-key shortcut such as a function key. Another shortcut for mouse users is to click on the text "F2 Toggle A/D Mode" 68 at the bottom of the monitor.

The "Clear Message" menu item removes from the puzzle grid all fixed-position letters and fixed-position theme words. These were placed by the user and are collectively called the message. This function leaves the pattern alone.

Figure 2D:
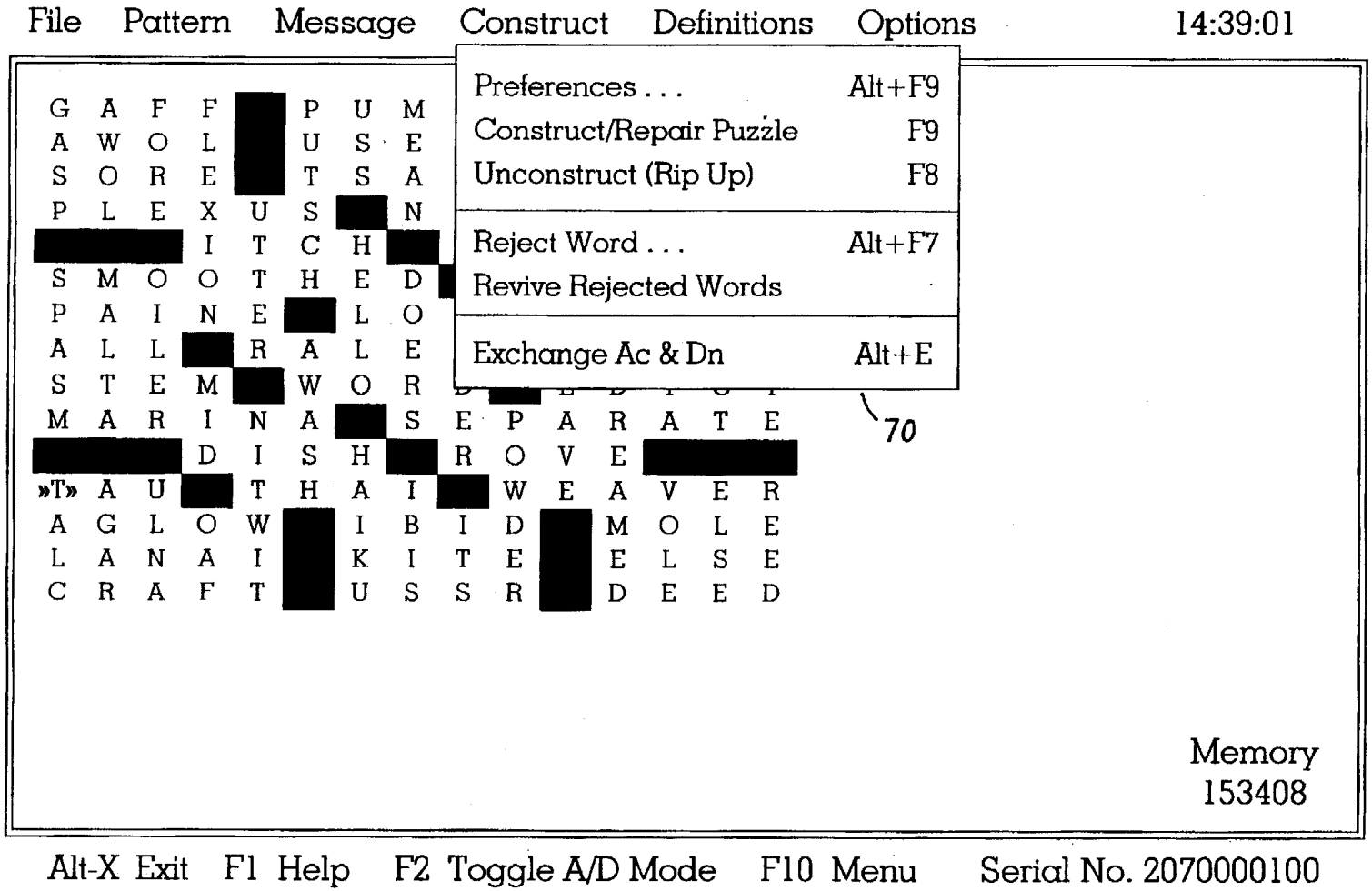

FIG. 2D shows the "Construct" pull-down menu 70. It displays commands for controlling and activating the crossword construction engine.

The "Preferences" menu item calls up a dialog box that presents the following construction options. The user can choose any one of them at a time:

( ) Unusual Words
( ) Words with letters ZXQJK, etc.
(•) Fastest Construction
( ) Random Construction (Where Possible)

Puzzles made with different preferences are usually different.

The "Construct/Repair Puzzle" menu item initiates construction of the puzzle by the construction engine. If the puzzle is already partly constructed, it will attempt to fill in the blank cells without disturbing what is already there. A good shortcut is function key F9.

The "Unconstruct (Rip Up)" menu item erases all words and letters placed by the construction engine, without disturbing the pattern or fixed-position theme words (message) and letters placed by the user. This is useful in case the automatically constructed puzzle is not satisfactory for some reason, or the user wants to experiment with different message words or construction preferences. Shortcut: Function key F8.

The "Reject Word" menu item allows the user to prevent one or more words from being placed in the puzzle. As the program constructs the puzzle, it places many words in the grid. If the user does not like one of them, he or she can "reject" it by using this command. The program maintains a list of rejected words so the command can be used several times for different words.

First, the user identifies the undesired word by placing the directional cursor on it and executing the reject word command. Next, the user either unconstructs the puzzle, or, to retain most of the puzzle and repair only the offending part, the user can erase some cells he or she does not mind changing. At least part of the rejected word should be erased. The user then sends the Construct/Repair command to fill in the erased area. The rejected word(s) are effectively blocked from the lexicon so they do not come up again. If the user erased a very small area, the program might report that it is stuck. Then a larger area needs to be erased.

An improvement would be for the construction engine or user interface to automatically remove the rejected word and attempt to repair the puzzle. If repair is not possible after the first attempt, it could make several more attempts with each attempt first erasing a successively larger area of neighboring cells. Of course, it should not take the liberty of erasing the user's fixed-position message words and letters.

The reject word command gives the user the opportunity to alter the word being rejected. It treats some symbol, such as "?" and/or "–", as a wildcard letter. For example, "????ING" rejects all seven-letter words ending with "ING".

The "Revive Rejected Words" menu item purges the list of rejected words. This is useful when the user makes a mistake entering a rejected word. Even more useful would be a command that displays and allows editing of the list of rejected words.

The "Exchange Across & Down" menu item is the same as the Exchange Across & Down under the Pattern submenu. It is repeated here for convenience since it the only pattern manipulation function that has a meaningful use after construction, as discussed above.

Figure 2E:
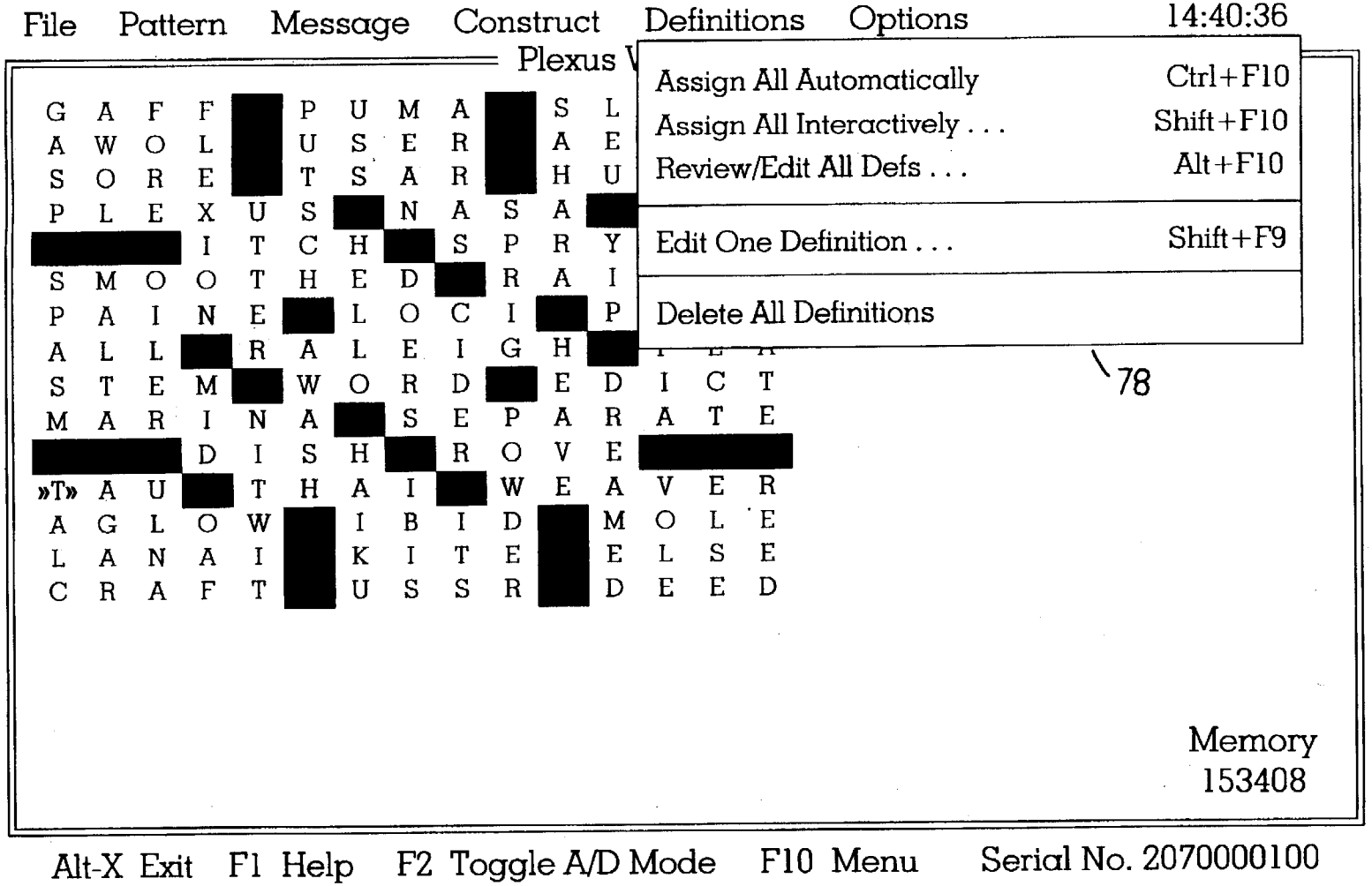

FIG. 2E shows the "Definitions" pull-down menu 78. It provides functions to assign clues to the puzzle. Crossword clues are also known as definitions.

The "Assign All Automatically" menu item causes the computer to search a database of clues and assign a clue to every answer word in the puzzle. This database should be separate from the lexicon so that the lexicon can be loaded quickly in its packed form. This database would be too large for that. It should contain or reference all (or at least most) of the words in the lexicon together with a number of clues for each word.

The "Assign All Interactively . . . " menu item also does the automatic assignment except that it stops after each answer word is found in the database to allow the user to select which of several available clues he or she desires. The user can also combine two clues by separating them with a semicolon, and edit the selected clue as desired. When the puzzle is saved, the selected and edited clues are saved with it.

The "Review/Edit All Defs . . . " menu item brings up all the answer words in the puzzle, one at a time, in a dialog box that enables the clue to be seen and edited.

The "Edit One Definition . . . " menu item brings up an edit clue dialog box for the answer word specified by the directional cursor.

The "Delete All Definitions" menu item does exactly what its name suggests.

Figure 2F:
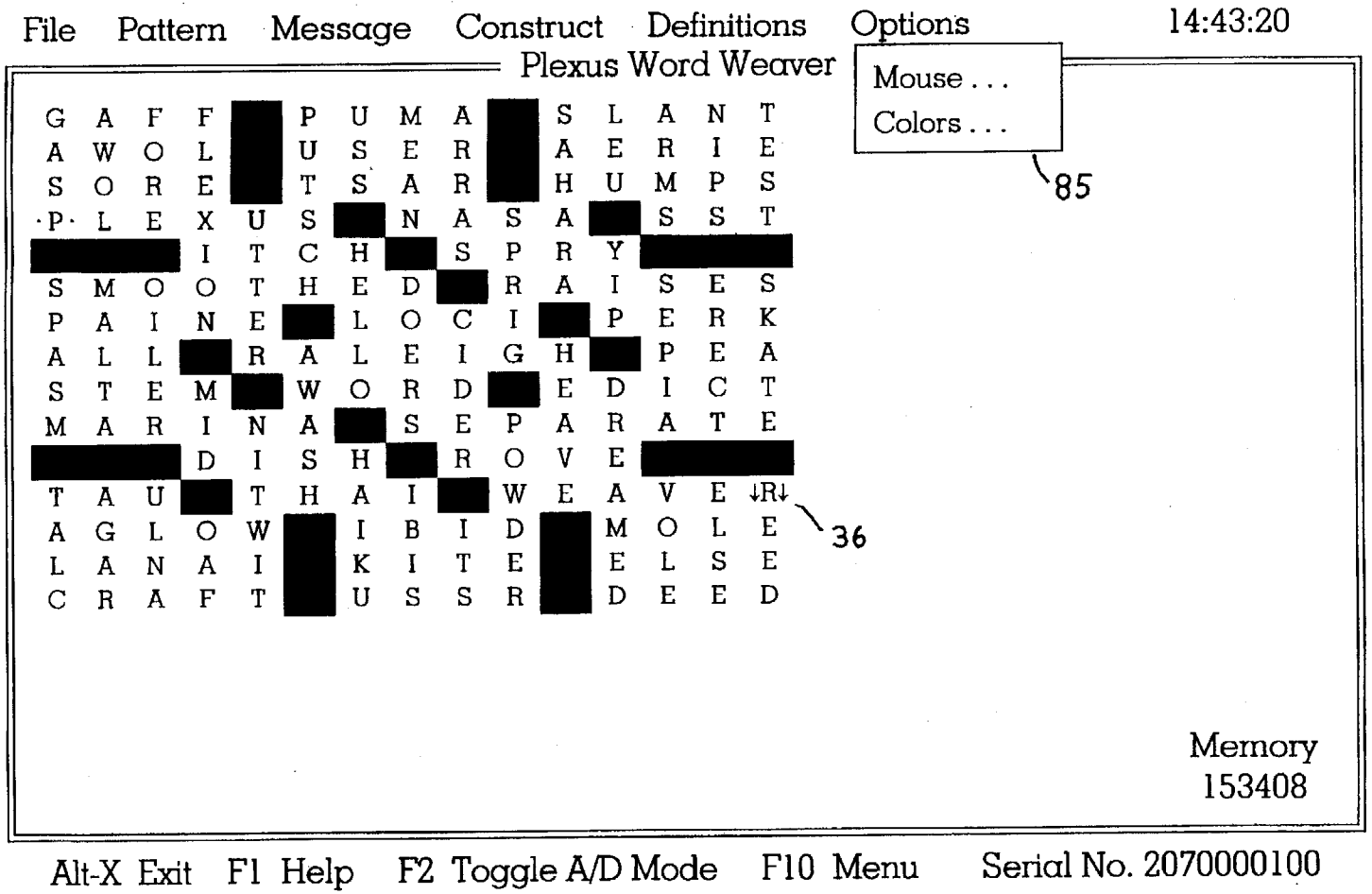

FIG. 2F shows the "Options" pull down menu 85. It provides some utilities for customizing the appearance and operation of the program.

The "Mouse . . . " menu item displays a dialog box that allows the user to adjust how rapidly he or she must click a mouse button twice for it to register as one double-click action. It also allows him to reverse the left and right mouse buttons.

The "Colors . . . " menu item allows customization of the display, which is useful on monitors for which the default display colors are hard to read.

Sometimes the user needs to specify a particular word in the grid, for example, when he wants to reject or clue (define) a word. He can use the mouse and directional cursor key for this. Clicking the mouse once on any cell in the word puts the curser on that cell. Aligning the curser's direction with the word's direction by clicking on "F2 Toggle A/D mode", if necessary, uniquely selects the desired word. Certain commands check the directional cursor to see if it is specifying a complete word that they can operate on. If so, they proceed with that word. However, because it is useful to reject a word that is nowhere on the grid, the reject word command provides an opportunity to edit the word that was lifted from the directional cursor before adding it to the rejected word list.

The Crossword Construction Engine

The invention must place words into the crossword puzzle grid that were not specifically selected by the user. These words can be thought of as glue words because they glue together the selected theme and message words in the pattern. The glue words are selected by computer from a prepared word list that is like a dictionary word list. An actual list of words obtained from a dictionary would be enough to make the invention work. However, some words are traditionally unacceptable in crossword puzzles. On the other hand, many non-dictionary words (such as names of famous persons) are often desirable. This means the list of words that can be used to glue together the puzzle will preferably be different from a pure dictionary word list. Herein, this list of words that can be used to glue together the puzzle will usually be called the "lexicon," regardless of how much or how little it resembles a dictionary word list.

Figure 4:
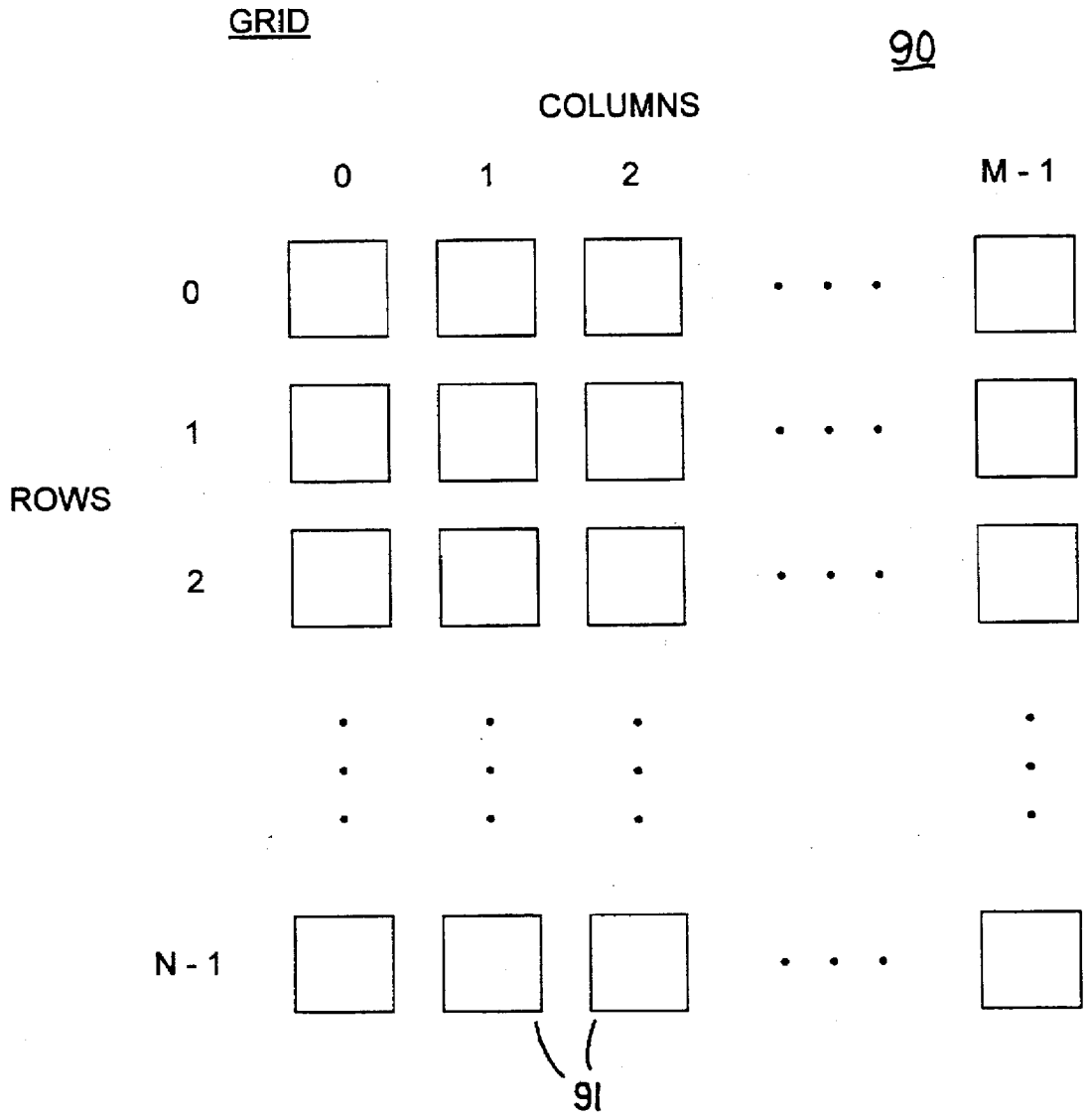
FIG. 4 depicts the one data structure by which the puzzle grid can be represented in memory.
Figure 5:
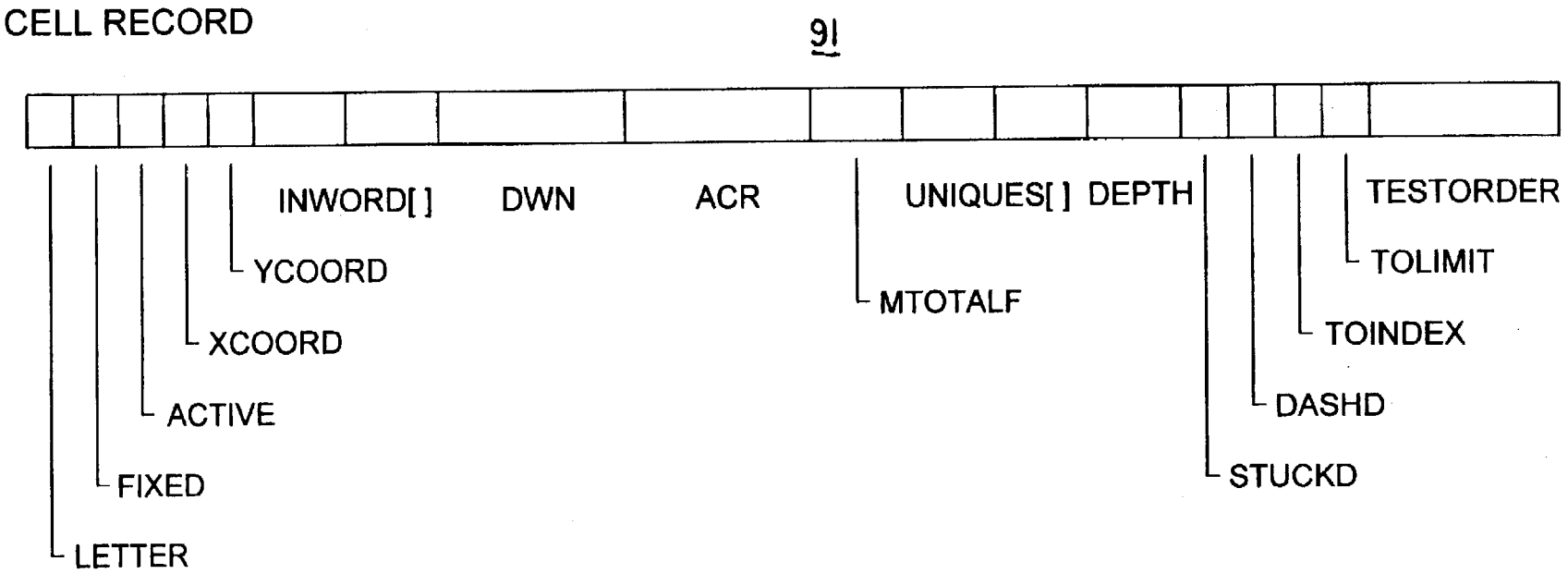
FIG. 5 depicts the data structure of each CELL record of the puzzle grid of FIG. 4.

FIG. 4 shows the overall data structure representing the puzzle grid in the computer memory (RAM). Each element of the grid represents a cell of the puzzle. Preferably, the grid is implemented as a two-dimensional array called GRID 90. (Alternatively, it could also be implemented as a linked list, a one-dimensional array, or an array of pointers to CELL records, each with rudimentary code modifications.) Each element of the GRID structure is a structure called a CELL record 91. A CELL record 91 is shown in greater detail in FIG. 5. The members of the CELL records are explained in the table below. The identifiers in the figure are all-upper case versions of the identifiers used in the source code in the microfiche deposit.

| Identifier | Description |
|---|---|
| LETTER | One byte holding the letter currently in assigned to the cell. If the cell is unassigned, a hyphen '-' is stored here. If blocked, an asterisk '*' is stored here. |
| FIXED | Binary flag that is true when the letter was required by the user (in a fixed-position theme word or letter) and false otherwise, as when unassigned or when assigned by the crossword construction engine. |
| ACTIVE | Binary flag indicating whether the cell is in the array CELLORDER. |
| XCOORD | The current cell's x-coordinate (row number) in GRID. |
| YCOORD | The current cell's y-coordinate (column number) in GRID. |
| INWORD[ ] | A pair of indices into the WORDS array referencing the across and down wordslots that intersect at this cell. |
| DWN | Pointer pointing to the flexibility record for this cell for the down wordslot. |
| ACR | Pointer pointing to the flexibility record for this cell for the across wordslot. |
| MTOTALF | The number of letters not contraindicated by the latest flexibility analysis. I.e., the number of letters in the set of possible letters. The set of possible letters is also called the possibilities set. This number is kept more up to date than TESTORDER, below. (The program has undergone so many revisions it isn't worth explaining where the name MTOTALF came from.) |
| UNIQUES[ ] | Number of unique letters in the flexibility count in each direction. (This element was useful during development.) |
| STUCKD | Distance from a stuck cell. This is used in case the construction engine gets stuck, to restart as far from the problem as possible. (This is optional.) |
| DASHD | Distance from nearest unassigned cell, used to determine which assigned cells should be "fixed" or "frozen." |
| TOINDEX | An iterative counter indexing the currently-assigned letter in TESTORDER. |
| TOLIMIT | Number of letters in the TESTORDER array. |
| TESTORDER | A pointer to an array of letters listing the set of possible letters (those not contraindicated by the latest flexibility analysis). When the cell is selected to be assigned a letter, this array of letters contains the possibilities set for the cell, in the order the letters should be tested. |

Some of these CELL members are optional or for convenience only. For example, the XCOORD and YCOORD members allow CELL records to be referenced by pointer where their indices in the GRID array are unknown. Then the indices can be determined by reference, allowing the cell's immediate neighbors to be identified. The INWORD[] array is used for similar purposes. This merely saves code and time by referencing data elements as conveniently as possible. Alternatively, the indices could be used throughout or pointers could be used throughout.

Figure 6:
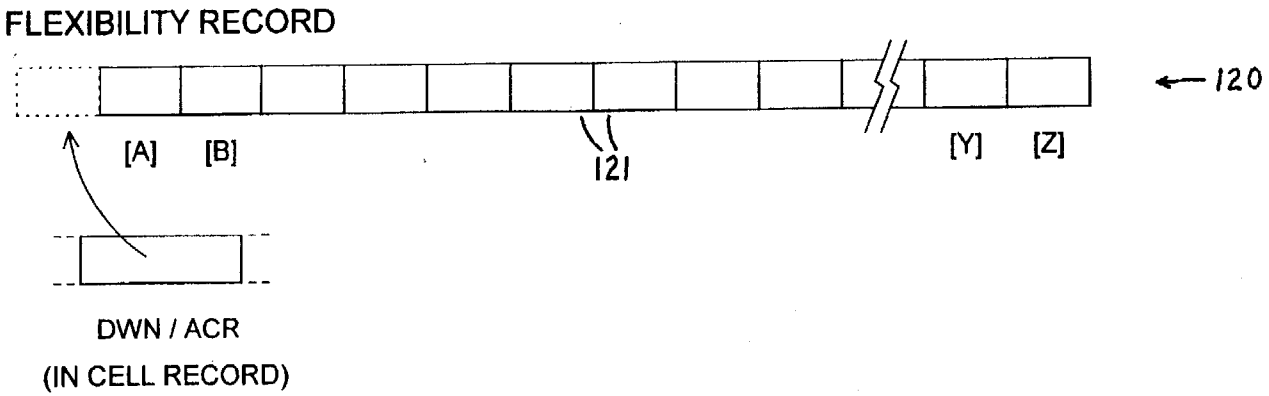
FIG. 6 depicts the data structure of a flexibility record for one cell and one direction.

The pointers ACR and DWN point to flexibility records. FIG. 6 shows a flexibility record 120 according to a first embodiment of the invention. Its main member is an array of 26 integers, one for each letter of the alphabet. These integers should each be able to represent the number of words in the longest dictionary word list.

The word slots of the puzzle are represented by an array called the WORDS array. The number of elements in the WORDS array limits the number of words that can be in a puzzle. Thus the WORDS array should large enough to handle the maximum number of words expected according to the capability desired.

Figure 7:
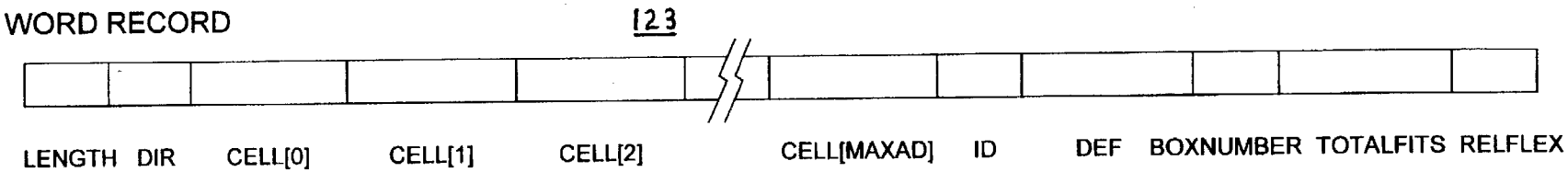
FIG. 7 depicts the data structure of a WORD record.

Each element of the WORDS array is a structure called a WORD record 123. FIG. 7 shows a WORD record 123, and its elements are explained in the table below.

| Identifier | Description |
|---|---|
| LENGTH | The length of the word slot. (I.e., the number of letters or cells in use for that word slot. This equals the size of the word.) |
| DIR | Integer representing ihe direction of the word, either across or down. It is an integer so it can be used as index to a two-element array. |
| CELL | An array of pointers to the CELL records that make up the word. One pointer is used for each letter, according to the length of the word. Any extra pointers are unused. |
| ID | An integer that is the index into WORDS that references the respective element of WORDS. It is also a unique number for identification of each word. |
| DEF | A pointer that points to a string containing the definition or clue. When the word is unclued the pointer is null. |
| BOXNUMBER | An integer for holding the number that will be printed in a box of the unsolved puzzle (see 15 in FIG. 1) and also to the left of the clue (see 13 in FIG. 1). Across word and down words starting at the same box share the same number. |
| TOTALFITS | An integer representing the number of lexicon words fitting this word slot according to the latest flexibility analysis. Depending on how the invention is implemented, this item might be unnecessary. |
| RELFLEX | An integer representing approximately the relative flexibility, i.e., TOTALFITS divided by word length. |

When the construction engine is activated, it examines the data it obtained from the user interface. This includes the pattern chosen or created by the user. At this point, if not earlier, the WORDS array and certain members of the CELL records must be initialized so that pointers point to the proper things, etc.

The lexicon is read into RAM. On disk, it is organized into separate smaller lists by word size. To save memory, the computer should to read into memory only the lists for the word sizes it needs, according to the wordslots of the pattern.

The constructor then initializes the flexibility records pointed to by the CELL records. It can do this by performing a flexibility analysis on every wordslot. By way of improvement, since all or most of the wordslots are empty or nearly empty at the beginning, it could do this by table lookup in a data file of prepared flexibility records for empty or nearly empty wordslots. With the flexibility records associated with each cell initialized, it verifies that all cells are either already assigned a letter or that the cell's possibilities set is not empty, i.e., that they can be assigned a letter. A cell can not be assigned a letter when the word slots that cross at the cell have no pair of words that share the same letter at that cell. This condition means the possibilities set is empty, and this condition is indicated by MTOTALF being zero.

One of the most important functions of the overall method is the flexibility analysis. In the singular, this term usually is used in the sense of analyzing one wordslot. In the plural, two or more wordslots, whatever it takes to bring the flexibility records up to date. The input to the flexibility analysis is a word fragment. For example, "R - - - T" is a five-letter word fragment that could be completed into about a dozen or so words. Empty and complete word fragments, such as "- - - - -" and "R I G H T," are trivial but valid inputs to a flexibility analysis. A wordslot is the usual source of the word fragment. A pointer to a WORD record in the WORDS array is enough, as is an index into the same array. The WORD record points to the individual CELL records in the GRID structure that are part of the wordslot. These CELL records contain the current state of each cell of the wordslot, whether it is empty, or if not empty, what letter it contains.

A flexibility analysis compares the current contents of a wordslot to the lexicon word list with matching word size. In the process it gathers useful data and summaries it. Most of this data is placed in flexibility records and the MTOTALF element of the CELL record 91.

FIG. 6 shows the structure of a flexibility record for one cell in one direction, according to a first embodiment of the invention. It is a structure having twenty-six integers, one for each letter of the alphabet from A to Z. These are tallies 121, i.e., counters. The tallies 121 should be able to represent numbers in the range from zero to the maximum number of words in the largest lexicon word list supported. Sixteen-bit integers are adequate. Other elements of the flexibility records are optional.

It is important to note that each cell has a flexibility record for each direction in which a word can appear, across and down. However, a flexibility analysis effects the flexibility records of the CELL records of the input word slot in one direction only. For example, a flexibility analysis of a five letter wordslot that is oriented across will rewrite the flexibility records pointed to by the five ACR pointers of the five CELL records of the wordslot. Each cell's transverse-direction flexibility record is updated at a different time. This may be either before or after, but always by individual flexibility analyses of the transverse wordslots.

A flexibility analysis is performed as follows. First, for each CELL record 91 in the wordslot, the twenty-six tallies 121 of the appropriately-oriented flexibility record are initialized with zeros. For a five-letter wordslot, this is 130 zeros. Then the word fragment is compared to the lexicon word list for that size wordslot, one lexicon word at a time. A lexicon word either conflicts with or does not conflict with the word fragment.

Conflicting lexicon words are those in which a letter actually in the word fragment is not equal to the letter in the corresponding position of the lexicon word. Conflicting lexicon words are skipped without further processing.

A lexicon word does not conflict when every letter actually in the word fragment matches the letter in the corresponding position of the lexicon word. Unassigned (blank or unknown) letters in the word fragment are treated like wild cards that can match any letter in the lexicon word without conflict. The word fragment "- - - - -" has no conflicting five-letter lexicon words.

Nonconflicting lexicon words are processed as follows. For each letter in the nonconflicting lexicon word, the tally 121 for that letter in the corresponding CELL record's flexibility record is incremented by one. The correct tally 121 for each letter is found using the letter's position in the lexicon word to reference the correct CELL record in the wordslot (e.g., first letter, first CELL record). The direction of the wordslot selects the correct flexibility record of this CELL record. Then the identity of the letter is used to select one of the twenty-six tallies 121 within the flexibility record. (Note that the only tallies of interest are those corresponding to the wordslot's unassigned cells, but because it take time to check this, there is little or no harm in processing all the tallies 121.) When all lexicon words have been compared, each tally 121 will be a count of how many words can fit in the wordslot and set the tally's cell to the tally's letter.

Figure 8:
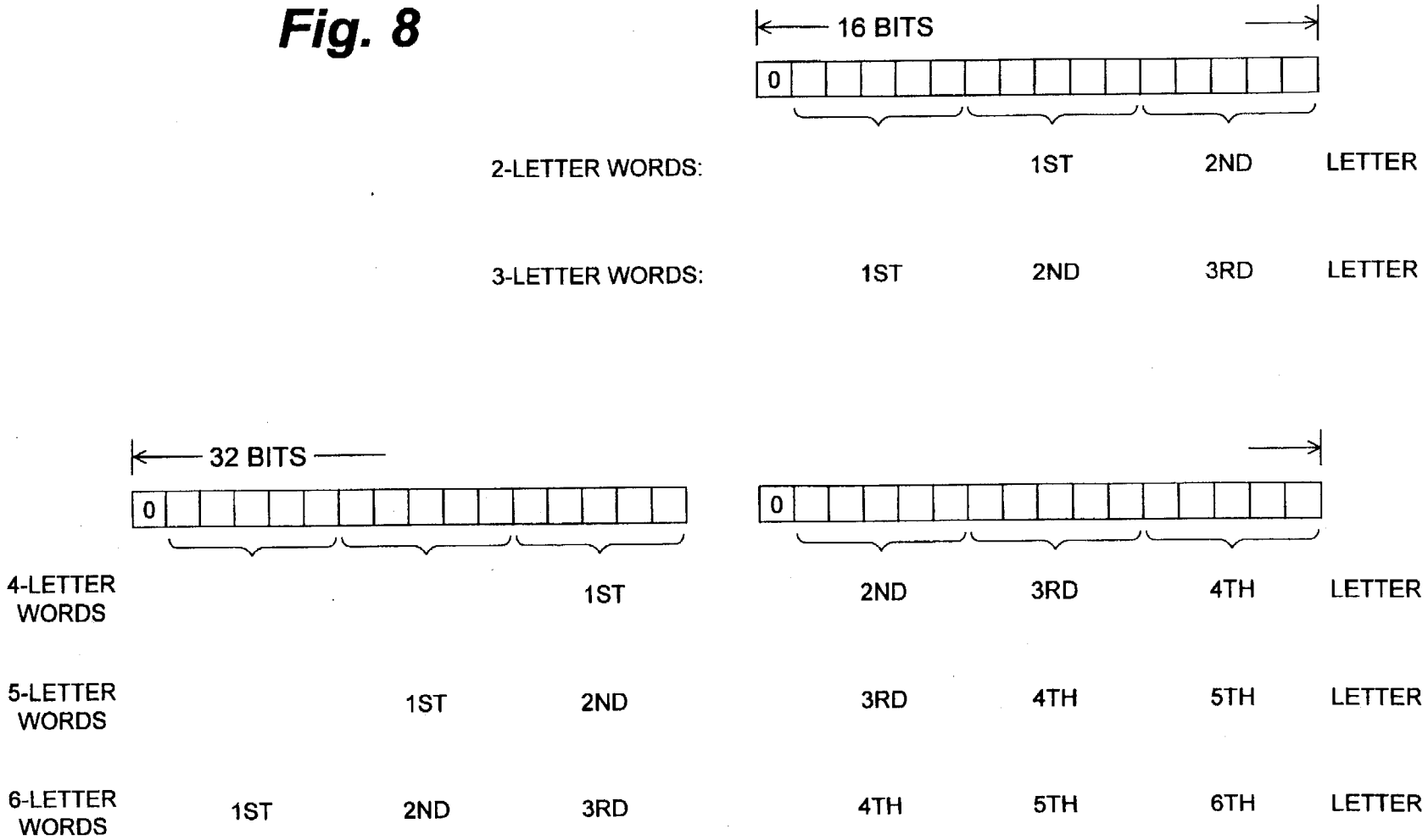
FIG. 8 depicts a packing data structure for various lengths of words of the lexicon.

The comparison of a word fragment to the lexicon word list, or scanning, can by done in many ways. One is as a series of single character (i.e., byte) comparisons. This is simple and can get the job done, but the simplicity is paid for in time and memory requirements, so it is not preferred. A second faster and more compact way of implementing the scanning is to pack the lexicon words using only five bits per letter. Five bits can distinguish among up to thirty-two letters of an alphabet. FIG. 8 shows such a packing scheme. In a computer with a 16-bit data path internally, three letters (15-bits) can be compared at once. In a 32-bit computer, six letters can be compared at once. Thus a five-letter word can be compared in either two steps or one step, respectively. This three-letters-per-sixteen-bits data structure is extended to represent words of any length. Grouping words according to size makes separators such as newline characters or comma's unnecessary.

The construction engine spends most of its time doing flexibility analyses. Therefore, it is important that these analyses and especially the scanning are done efficiently. The scanning code should be optimized for speed by providing separate code for each word size. The word size is used to determine which customized routine should do the scan. Scanning is much more efficient when it does not have to constantly recheck word size.

To prepare for multi-letter comparisons, it necessary to set up mask and pattern bit strings. Each of these must be long enough for the word fragment in question, that is, they must have a 5-bit bit field for each letter or unassigned letter according to the size of the word fragment. For each letter actually in the word fragment, the mask has a bit field of five binary ones and the pattern has a corresponding bit field of five binary digits that represents the identity of the letter itself. For each letter that is unassigned in the word fragment, the mask has a bit field of five binary zeros and the pattern has a corresponding bit field of five binary zeros. The comparison operation starts with a bitwise logical AND between a packed lexicon word and the mask. The result is compared for equality with the pattern bit string. If equal, the lexicon word is not conflicting. If more than one comparison step is necessary for long words, all must be equal for there to be no conflict. Note that unused bit fields in the mask and pattern should be initialized to so as to be nonconflicting, i.e., to zero. Alternatively, extra bit fields could be given some meaning by which certain lexicon words can be selectively blocked with no increase in scanning time. (This could have been, but is not, how the reject words feature was implemented.)

After the scanning is finished, the results are summarized as follows. This is done one CELL record at a time, for each cell in the wordslot. Within the cell, the down and across flexibility records are compared to determine the possibilities set. This is the set of letters that flexibility analyses were unable to rule out, thus they remain for potential assignment to that cell. A letter is ruled out if at least one of the tallies 121 for across or down is zero. If both are greater than zero, the letter is not ruled out. For each letter of the alphabet, the tally 121 associated with that letter in that cell in each direction is compared to zero. If corresponding tallies are greater than zero for both directions, it means that letter has not been ruled out for potential assignment to that cell. Each cell's MTOTALF element is set to the number of letters that are not ruled out. Thus, MTOTALF can be 0 to 26 inclusive. The above summarization is repeated for the other CELL records of the wordslot.

The above results will be valid when both down and across flexibility records of a cell are kept up to date, as is the case after initialization. It is necessary to update the flexibility record associated with a wordslot every time an assignment of a cell in the wordslot changes. Performing flexibility analyses after each assignment increases probability any following assignment will be consistent and will survive.

The lexicon is the collection of words that are permitted to form the "glue" that holds together the puzzle. The lexicon should be sufficiently large to contain enough words to find a solution to a given problem. The more words, the more likely the invention will be able to construct a given puzzle. A few tens of thousands of words of sizes two through seventeen letters is recommended. A total of 30,000 words can do the job for many puzzles; 70,000 is much better. The most important word sizes to have are those in the range of three to six letters, as this is where most glue words tend to be needed.

The Method of Construction

The process of filling the grid with glue words is based on assigning letters to the empty cells, not by assigning glue words to wordslots. Only fixed and floating theme words can be assigned in their entirety, not glue words. Usually, cells are assigned one at a time. After each assignment, down and across flexibility analyses are performed. The next assignment is based on the results of the flexibility analyses from the previous assignments, and more particularly the latest one. The goal is to discover and rule out existing conflicts early, identify forced assignments so they can be explored, and for elective assignments, to logically step through the possibilities.

1. Getting Started

The process of building a puzzle begins by initializing all the flexibility records. The word slots that are empty can be initialized by lookup table. If there are any non-empty wordslots, the fixed matter (words and letters) placed by the user must be taken into consideration.

When all flexibility records are initialized, the computer must find the cell(s) with the lowest MTOTALF. If the lowest MTOTALF is zero at this early stage, the puzzle can not be completed and this problem should be reported to the user. Otherwise, the program chooses a place to start. Usually this is not a critical decision. The best place to start is with the cell that has the lowest MTOTALF.

Alternatively, it would be useful to defer to the user's preference on where to start. One way the user could indicate a preference by placing the directional cursor on an unassigned cell just before activating the construction engine. A special "start here" construct command could be provided to explicitly override the program's choice of where to start.

2. Choice of Cell to Assign

Whenever a cell is changed, a flexibility analysis is performed on the word slots that cross at that cell. This keeps all active flexibility records current. The flexibility analysis reveals the extent to which existing assignments have restricted the possibilities of neighboring cells. These flexibility analyses can result one in three states: (1) Contraindication, (2) forced assignments, and (3) freedom to elect assignments.

Contraindication takes priority over all other states. It occurs when there is an empty cell somewhere for which no letter can be assigned, that is, when the MTOTALF element contains a zero. The preferred way of handling a contraindication is to undo the latest assignments all the way back to the last elective assignment for which an untested election is still possible. If the last elective assignment was the last election at that level, the construction engine should go back even further. If it goes back all the way to the beginning without finding another elective assignment with an untested election, the problem should be reported to the user. (As will be explained below, sometimes mandatory floating theme words, if any, can be rearranged at this point in an attempt to avoid the problem.)

A forced assignment is next in priority. It occurs when one or more empty cells have been restricted to the point where they can have can have one and only one letter each. (MTOTALF for one or more cells contains a one.) That is, when there is no contraindication and when there is at least one cell for which the intersection of the sets of letter possibilities of the down and across wordslots results in only one letter. For example, the only empty cell in the across wordslot "D - G" has a possibility set of {"T", "O", "U"}. The wordslot intersecting at that empty cell, "- C E", was previously determined to have the possibility set of {"A", "T"}. The intersection of these individual sets is {"T"}, so this is a forced assignment. In this example, the TESTORDER array would contain only the "T" and MTOTALF would be 1. (Forced assignments are not to be confused with fixed-position theme words or letters, which are established by the user in edit mode.)

When there is no contraindication and no forced assignment, then every remaining empty cell can have one of at least two letters, so far as has been determined. In other words, the MTOTALF element of every unassigned cell is greater than one, and the TESTORDER array of each unassigned cell contains more than one letter. The construction engine must selectively choose which cell to assign and what letter to assign to that cell. No best way of doing this is known. The fact that assignments are made one cell at a time, with flexibility analyses ruling out most useless prospective assignments and discovering forced assignments brings the construction engine to a point where there are many ways to proceed.

Nevertheless, the following guidelines should be followed to help minimize the circumstances under which the construction engine gets lost. It may be lost when its activities appear to be uselessly trying to change the same area over and over with only minor changes elsewhere. Sometimes it will find its way out on its own. If the user does not want to wait, he or she should be able to interrupt it and make a small change to the construction request before trying again.

The flexibility of assignment, both generally and as represented by the MTOTALF element of the CELL records, is best preserved for later assignments and should not be consumed all at once. This means the construction engine should look for a cell that has a low MTOTALF count. By assigning to such a cell first, the flexibility of assignment in other cells is preserved for when it is needed. This also tends to reduce the frequency with which the construction engine leaves behind a few isolated unassigned cells as it moves to other areas of the puzzle.

The assignment of a cell tends to lower the MTOTALF counts in other cells in that cell's wordslots. The construction engine should not be allowed to always follow a linear chain of falling MTOTALF counts when it does not have to. This the piecewise equivalent of assigning glue words a whole word at a time. Flexibility is best used when it becomes limited as a result of interactions among many intersecting wordslots of a cluster of cells. Therefore, before assigning a cell with a high MTOTALF count, which is in the same wordslot as a recent assignment, the construction engine should assign a cell that is diagonal to the recently assigned cells and close enough to still be in the same cluster of "active" cells. "Active" cells, generally, are those that have been recently assigned or touched by an assignment in their wordslot.

As the construction engine assigns letters to cells and evaluates them, it likely will encounter dead ends. A dead end requires the construction engine to undo one or more assignments before proceeding. This is called backtracking. (Changing an assignment is the same thing as undoing an assignment and redoing it differently.) The preferred way of backtracking is to undo the latest assignments in reverse order of assignment. The assignment history is stored in a Last-In, First-Out (LIFO) stack. The LIFO stack can be either an expressly defined data structure or implicit in a recursive subroutine, in which case the system stack is used. The recursive subroutine makes at least one assignment every time it is called. It returns to its caller when it encounters a dead end or (with a special return code) when it finishes construction of the puzzle. The recursive subroutine should be lean enough and system stack large enough so the former can never eat up more memory than the latter can provide.

The LIFO assignment and backtrack policy works best when a series of subsequently assigned cells are close to each other on the grid. That is, that the series of cells are all members of the same cluster of cells, and not scattered across the puzzle or separated by blocked cells. This is expressed by a concept called "farness." Farness is the number of wordslots that must be traversed to get from one cell to the other. Thus, farness is a measure of how related two cells are, how directly or remotely an assignment in one affects the options of the other. One satisfactory definition of farness is:

| Farness | Meaning |
|---|---|
| 0 | The two cells are identical. |
| 1 | The two cells are in the same wordslot. |
| 2 | Two wordslots crossing at the first cell each intersect a wordslot that elsewhere includes the second cell. |
| 3 | Only one wordslot that includes the first cell intersects a wordslot that elsewhere includes the second cell. |
| 4 | Farness levels 0–3 do not apply, that is, the cells are no more closely related than two cells in two different wordslots that are both crossed by a third wordslot. |

This definition can be improved to exclude paths that contain words having been fixed long ago and therefore cannot change without a lot of backtracking.

The computer should choose a cell to assign in a way that protects and makes meaningful the LIFO assignment and backtrack policy. This means that the cells of choice should be related to each other (below a certain threshold of farness) and, to the extent possible, one cluster should be completed before another is started.

The normal LIFO backtrack method should be overridden to preserve completed clusters. Sometimes the area of activity in which cells are being assigned branches off into a closed-off portion of the puzzle pattern. After it assigns the last unassigned cell in this closed-off area, the construction engine's area of activity usually has to leap to another part of the puzzle. Usually, the destination of the leap will be near the "entrance" of the closed-off area, where it most recently chose to branch off. At this entrance will be some cells with relatively old assignments and some unassigned cells. Often, the construction engine can assign the unassigned cells without difficulty. However, depending on the size of the lexicon and other factors, it may find a contradiction and have to unassign some cells before it can proceed. If it followed the normal LIFO backtrack method at this point, the recently-completed cluster would have to be undone at considerable waste. So according to the override, the construction engine leaves the recently-completed cluster alone and unassigns the nearby relatively old assignments.

This override is implemented by occasionally "fixing" or "freezing" the assignments of cells that are deeply imbedded in other assigned cells. The occasion when fixing or freezing is done is whenever the construction engine must leap from one cell to another with a farness above a certain threshold (e.g., three or above). The frozen cells are in effect removed from the LIFO stack when they are frozen. With the recently-completed cluster frozen, backtracking over a leap causes the construction engine to return back to the place where it most recently assigned a cell that is was in close proximity to an unassigned cell at the time of freezing. (Its proximity to an unassigned cell is what kept it from being fixed or frozen too.) Often, this is near enough to the contraindication so it can be quickly resolved.

For this to work, every time a cell is chosen to be assigned, the second runner up, third runner up, etc., are stored in a sorted list. As the new cells are activated because they are touched by an assignment somewhere in their wordslot, they are added to this list. When a leap is required because the last cell of a cluster is assigned, the next cell on this sorted list is near the entrance to the cluster.

Thus, the construction engine detects when a closed-off area is completed and marks the closed-off cells as "fixed" or "frozen," so that additional backtracking can skip over the frozen portion. In the conceptual search tree of assignments, this is designed to leave alone a completed branch and skip directly to a different branch. ("Fixed" here has nothing to do with cells that are fixed because they are part of fixed-position theme words or letters. That is a higher level of "fixedness.)

3. Choice of Letter

A choice of letter exists whenever no unassigned cell is forced to be a particular letter. The letters in the possibility set each have tallies with different numbers in them. Assigning letters with high tally counts preserves, rather than consumes, flexibility for future assignments. When a choice of letter exists, the letters in the possibility set must be assigned in some order. The first one tried might stick, which means that it lasts without being unassigned until the puzzle construction is successfully completed. But if it leads to a dead end (contradiction) some other letter will have to be tried until all of them have been tested. If all have been tested, then this condition is treated the same as if the set of possible letters were empty. In other words, previous assignments must be undone.

The policy of assigning letters in sequence from highest tally count to lowest tally count appears to result in the highest chance that a letter will stick. Thus, this is the " Fastest Construction" option in the preferences dialog box in the construct menu.

Surprisingly, experiments have shown that this method of constructing crossword puzzles is remarkably insensitive to choice-of-letter decisions. Other methods of making choice-of-letter decisions, on the average, tend to be only a little more time-consuming than the "Fastest Construction" method. A more important consequence of the method is the type of words that end up in the completed puzzle. The "Fastest Construction" option has the tendency to use a lot of frequently encountered letters such as "T", "S", "R", and all vowels, and also words with common endings such as "S", "ING" and "TION".

The "Unusual Words" tends to produce words that are lexically unusual and few words with common endings. This method is implemented by testing letters in the order from lowest tally count to highest.

The "Words with letters ZXQJK, etc." option tries to make sure that several of these infrequently encountered letters appear somewhere in the puzzle. It is implemented by trying these letters first, based on which of them are not yet in the puzzle.

The "Random Construction (Where Possible)" option seems to work best in producing a well-balanced puzzle. It is implemented by randomly choosing letters from the set of possible letters. This option will almost always produce a different puzzle than the time before. If this is undesireable, the random number seed should be restored to the same state before each construction.

Rejected words and duplicate words are processed as follows. Every time a letter is assigned to a cell, before anything else is done, the wordslots intersecting at that cell are examined to see if this assignment completes a word, that is, if this assignment was the last unassigned cell in any wordslot. If so, the newly completed word(s) are checked against the list of rejected words. To suppress duplicate words, the newly completed word(s) are also checked against all other completed words in the puzzle. If any of these checks results in a match, then the assignment of that letter to that cell must be reversed, just as if it were not possible to make that assignment for some other reason. In other words, it is treated like a contradiction.

Improvements

The data structure and method disclosed above and in the appendix works. Since the completion and testing of the source code in the appendix, several improvements have been contemplated. The improvements either provide new capabilities, increase speed, increase the probability that a particular construction request will be successful, or otherwise improve performance.

The most important new capability allows the user to specify theme words that are to appear in the puzzle without specifying where they are to appear. These are called "floating theme words" to distinguish them from the fixed-position theme words or message words disclosed previously and in the appendix. Floating theme words can be "mandatory theme words" or "priority theme words." Preferably, the capabilities to do both types are provided to the user, but either one is an improvement.

The user specifies mandatory and/or priority theme words through a new menu item added to the "Message" pull down menu. A single menu item (and single dialog box) is preferred for both types of floating theme words to make it easy to change a word from mandatory to priority and vice versa, without having to retype the word. The user should also be able to read and write floating theme words from a file that is distinct from the puzzle file. When the puzzle file is saved, the list of floating theme words should be saved with it.

The construction engine attempts to place as many floating theme words in the puzzle as possible. Mandatory theme words differ from priority theme words in that, when construction of a puzzle is complete, the construction engine verifies that all the mandatory theme word made it into the puzzle. If not, it tries again by starting over with a different random number seed. The user should also be able to tell the construction engine to choose a crossword puzzle pattern that matches the needs of the mandatory theme words. It matches if it has the right lengths of wordslots in sufficient quantities. If the user has selected this option, the construction engine may start over with a different pattern as well, after several different random number seeds have not worked out. Thus, all mandatory theme words have the same priority: they are mandatory. In contrast, priority theme words have a higher priority than the glue words (which come from the lexicon).

The construction engine should attempt to place the floating theme words as follows: Every time there is a choice of cell decision, before proceeding with the regular choice of cell steps, the construction engine should search the active cells for a wordslot into which a floating theme word can fit. This involves a comparison of several wordslots and all the floating theme words. The mandatory theme words should be inserted into the puzzle before the priority theme words are considered.

Whenever a floating theme word is found to fit a wordslot, the necessary assignments are made to put it there, and the search at this level is suspended (saved in an iterative counter) in case it has to continue later. Then the necessary flexibility analyses are performed and the process continues as usual at a lower level in the search tree. The placement of a theme word should be treated like an elective assignment of a cell except that several cells were assigned. The probability of that such an assignment will stick is lower than with a single cell, but the reward of a theme word makes it worth it. As soon as another choice of cell comes up, another search commences for a wordslot for one of the remaining floating theme words.

If a floating theme word must be unassigned, its wordslot should be restored to the state it had before the assignment was made. The suspended search then continues. If this search terminates without placing a floating theme word, then the regular choice of cell steps are performed to fill that area with glue words from the lexicon.

The breadth of the search (how many wordslots it considers) is not critical. It should be implemented as a parameter adjustable by the user. It could also be made automatically adjustable by the construction engine for making subsequent attempts at placing all mandatory theme words. In any case, it should start with the most fully assigned and inflexible wordslots first and proceed to the less assigned and flexible wordslots last.

This method of placing floating theme words is expected to result in an unbalanced distribution of these words throughout the puzzle. (Except when the user attempts to place hundreds of priority theme words in the puzzle, not caring which ones actually make it.) It might not matter or even be noticed by the ultimate puzzle solvers. If it does matter, the ability to adjust parameters such as the one described above could be useful in achieving some balance by trial and error.

The preferred way of giving the user the ability to require balance, at least for mandatory theme words, is to allow the user to choose an alternate placement method. By this method, before the construction engine starts anything else, it places all mandatory theme words into various word slots in the puzzle, in a well balanced manner. Then it attempts to construct the puzzle, including the placement of any priority theme words the user may have specified. If this puzzle cannot be completed, the construction engine starts over with another balanced arrangement of mandatory theme words. This continues until it terminates successfully, the user interrupts it, or (maybe) all possible balanced arrangements of the mandatory theme words have been tried. In most cases, there will be so many ways to place the mandatory theme words that it will not run out of new ways to try for a long time, thus the placements can be done randomly without much chance of repetition.

Careful analysis of the program's operation reveals that the same flexibility analyses are sometimes repeated. In particular, it is necessary to restore the flexibility records of a wordslot to a previous state whenever backtracking occurs. A flexibility analysis of a wordslot can be uniquely identified by the wordslot contents at the time of the analysis (i.e., the size of the wordslot, which cells are unassigned, and which letters are assigned to the assigned cells.) Because the lexicon does not change, the analysis need not be repeated if the results are saved. Thus savings could be achieved by treating the results of flexibility analyses for each wordslot as a LIFO stack, with the top member being the current one and a previous state restored by popping it off the top.

The same flexibility analyses can be repeated several time for other reasons as well. These do not fall into the LIFO stack model and are harder to predict. The preferred was of saving the results of flexibility analyses is in a software-implemented cache. Before each analysis is done, the contents of the wordslot to be analyzed should be quickly checked a against record of the flexibility analyses that were previously performed and for which the results are still available. This can be done quickly by hashing on the wordslot size and one other hash key such as the first alphabetic letter assigned or the arrangement of assigned and unassigned cells. A cache hit results in the recorded result being made available to each cell of the wordslot. A cache miss results in an actual analysis being performed, and a new record of the results being entered into the cache. If the cache is out of memory space, then some record will have to be selected for removal such as the oldest or least recently used record.

The tallies in the flexibility records predict which cells and wordslots are most constricted. It appears this is most useful when overall flexibility is high, meaning that virtually any letter can be placed in any cell. At such a point, the difference between tallies is in the magnitude of their counts, and not whether anything was counted at all for a particular letter. This occurs most often as at the beginning of construction. It is useful to determine where the first words or letters ought to be placed in a predominately unassigned pattern. However, even then, because there is so much flexibility, it is not very important to use this information to make that decision.

When construction is taking place in the absence of much flexibility, the flexibility analyses often rules out particular letters for particular cells. In these circumstances, the greatest benefit appears to come from making decisions based on which letters are and are not ruled out, and that the magnitude of the actual counts or tallies can be ignored. Thus, each letter/cell combination requires only one bit to store the result of a flexibility analysis. Four bytes (one 32-bit word) can replace the flexibility record of FIG. 6, with twenty-six bits used for the twenty-six letters of the alphabet. This arrangement saves storage and greatly expands the capacity of the flexibility record cache discussed above. Instead of incrementing tallies, the flexibility analysis should set the appropriate bit. The same bit may be set many times. If the flexibility record is stored in a thirty-two bit word as suggested above, the comparison of the across and down flexibility records only requires one 32-bit logical AND operation. If this results in zero, a contraindication was discovered. Otherwise, the TESTORDER array for each unassigned cell should be generated by bitwise analysis of the non-zero result.

Figure 9:
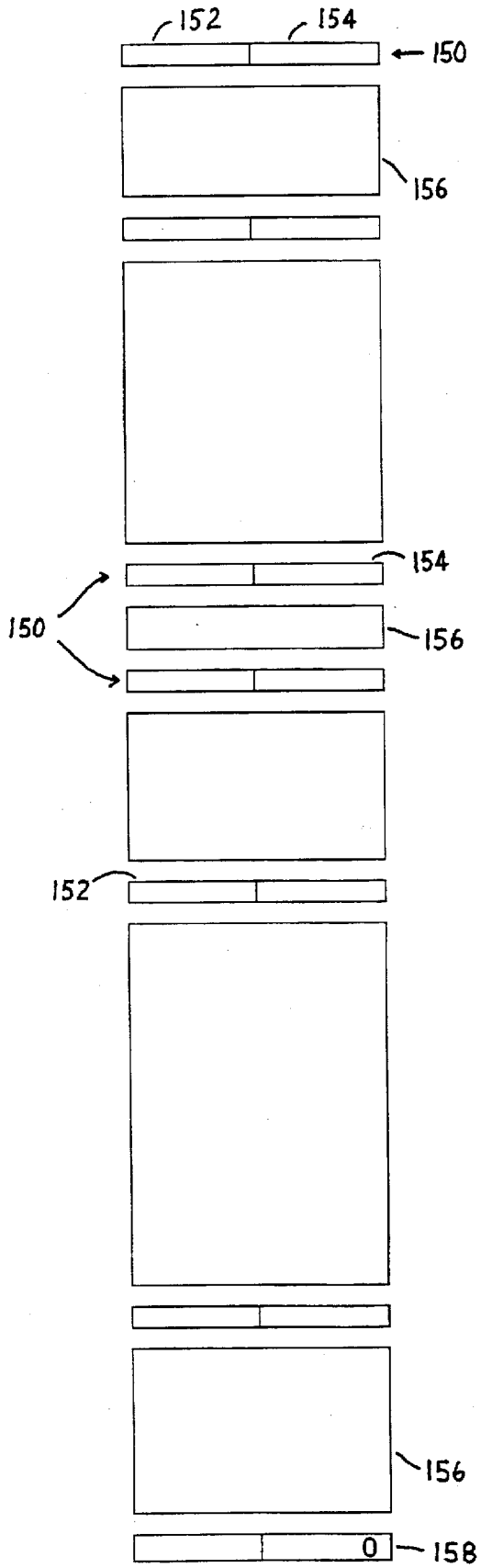
FIG. 9 depicts a sectioned data structure for the lexicon.

A flexibility analysis can be made faster in several ways. One way is to use a sectioned data structure for the lexicon. FIG. 9 shows an example of a sectioned lexicon data structure. As with the previously taught (unsectioned) lexicon data structure, the sectioned data structure also provides for a separate word list for each word size. But the sectioned data structure is more complex. Let x represent the word size of each list, i.e., the number of letters in each word of that list. In the sectioned lexicon structure, each word list is divided into $B^X$ sections, where B (the base) is a small whole number such as 2, 3, 4 or 5. For optimum performance, small word sizes should use a larger base such as four and small word sizes should use a small base such as two. Larger bases could work, especially for small word sizes, but are not as practical. A base of one is effectively unsectioned; it is useful for lists of very large words (over nine letters).

To allocate the words among the sections, the alphabet is divided into B sets or groups of letters. For example, for a base of two, an acceptable grouping could be A–L for group I and M–Z for group II. Each section in a word list is associated with a unique combination of groups I and II among the letter positions. Each word of the list is found in the section having the right combination of groupings for that word. Thus, each of the $B^X$ sections contain all the words, and only the words, that are appropriate for that section. The sections are numbered from 0 to $B^X-1$.

Each section has a section header 150 associated with it. The section header 150 contains a section ID field 152 and a section size field 154. Since each word list is processed by its own section of computer codes, the size of these fields may vary among the various word lists for the various sizes of words. Whether they are bit fields or in easily loaded multiples of bytes is a speed/size tradeoff that may be resolved differently for different word sizes. The section header 150 is followed by the section word list 156, the packed codes of the words that belong in that section. The same 5-bit packing scheme used for nonsectioned word lists can be used here also.

The section ID field 152 contains x subfields, one for each letter of the word size. The subfields are one bit each where B is two, two bits each where B is three or four, and three bits each where B is five to eight.

The section size field 154 should be a count of the number of words in the section. (Alternatively, it could be the number of bytes the section occupies, exclusive of the header, if done consistently.) If the section is larger that the sections size field can accomodate, there is no harm in breaking the section up into two or more pseudo-sections that have the same section ID. (Pseudo sections with the same section ID are all considered one section.)

The sections can appear in any arbitrary sequence. Empty sections should not appear at all. The bounds of each word list can be indicated preferrably by a sentinal after the last section of each word list, such as an extra section header 158 with a section size of zero. (Alternatively, total number of sections and pseudo sections in the each word list can be provided up front.)

As an example, using a base of two, the list of three-letter words is divided into eight sections. These sections are numbered from 0 to $2^3-1$, which is 0 to 7. The section numbers can be expressed as numbers in base B, each number having x digits. In the example, the base is binary and the section numbers are: 000, 001, 010, 011, 100, 101, 110, and 111. Binary zero is arbitrarily assigned group I and binary one is arbitrarily assigned group II. The eight sections for three-letter words are listed in the following table:

| Section ID | First Letter | Second Letter | Third Letter | Examples of Words |
|---|---|---|---|---|
| 0 - 000 | Group I | Group I | Group I | AGE, DAD, EGG |
| 1 - 001 | Group I | Group I | Group II | AIR, EAR, HAY |
| 2 - 010 | Group I | Group II | Group I | APE, COD, HUE |
| 3 - 011 | Group I | Group II | Group II | APT, FRY, HOT |
| 4 - 100 | Group II | Group I | Group I | SAD, TAG, TEE |
| 5 - 101 | Group II | Group I | Group II | MIX, SAW, WAX |
| 6 - 110 | Group II | Group II | Group I | MUD, ONE, TOE |
| 7 - 111 | Group II | Group II | Group II | MOP, NUT, TRY |

The grouping A–L and M–Z is convenient for illustrative purposes. It would work, but so would many other groupings that divide the alphabet. The groupings can be arbitrary, with a twenty-six element array used to store and look up the group number for each letter. Another way for bases two and four only is to use one or two bits of the five-bit packed code for groupings. Then these one or two bits are the group number of that letter.

The base should be chosen for each word size so that the average section has enough words in it to justify the overhead of processing the sections. When using a look-up table to distinguish groups, it is predicted that an adequate choice of bases for word sizes two through ten would be 4, 4, 4, 3 or 4, 3, 2, 2, 2, 1. When using packed codes to distinguish groups, it is predicted that an adequate choice of bases for word sizes two through ten would be 4, 4, 4, 4, 2, 2, 2, 2, and 1. For words longer than nine-letters, a base of two is expected to eat up too much memory, considering how few large words can appear in one puzzle.

When doing a flexibility analysis, the scan of a sectioned word list is done as follows. First, the word fragment that is the input to the flexibility analysis is examined to produce a section mask and a section pattern. These are used to control which sections are scanned and which are skipped. Both section mask and section pattern correspond subfield by subfield with the section ID field 152 of the section headers 150. For each letter actually in the word fragment, the section mask has a subfield of all binary ones and the section pattern has a corresponding subfield of the binary digits that represents the identity of the group of which the letter in that letter position is a member. For each letter that is unassigned in the word fragment, the section mask has a subfield of all binary zeros and the section pattern has a corresponding subfield of all binary zeros. Note that unused bit fields in the section mask and section pattern should be initialized to so as to be nonconflicting, i.e., to zero.

It is also necessary to prepare the regular mask and pattern as used with unsectioned word lists, as discussed above. This means there are section mask, section pattern, regular mask and regular pattern prepared in variables somewhere.

The scan is implemented as a pair of nested loops. The outer loop examines the section headers to determine which should be skipped and which should be scanned. A bitwise logical AND is performed between a the section ID and the section mask. This result is compared for equality with the section pattern. If unequal, then the entire section is skipped. The inner loop is not reached; instead, the section size field and section header size are used to advance to the beginning of the next section to examine another section ID. The outer loop continues until the last section has been processed. This can be indicated by an extra section header of size zero.

If the comparison involving the section pattern turns out equal, then the section needs to be scanned. The inner loop should scan the section using the regular mask and regular pattern just as was done with unsectioned word lists, except that the section size is used to limit the scan rather than the word list size.

One advantage of the alternate data structure is a significant increase in speed. Assigning the five cells of a five letter wordslot generally requires five flexibility analyses (considering one direction at a time). With unsectioned word lists, each flexibility analysis is performed by doing a full scans of the entire lexicon list for five letter words. In contrast, with sectioned word lists, only some of the sections need to be scanned. When B is two, for each letter that is assigned in the wordslot under analysis, half the sections can be ruled out. Thus, assigning the five cells in a five-letter wordslot requires $\frac{1}{2}+\frac{1}{4}+\frac{1}{8}+\frac{1}{16}+\frac{1}{32}$ scans (considering one direction at a time). This adds up to less than one full scan, plus a small amount of overhead to manage the inclusion or exclusion of sections. When B is four, the limit is one-third full scan. These limits are a function of B and not the word size. Since every cell in the puzzle will be assigned, the flexibility analysis in the other direction (e.g., down instead of across) will also realize this savings.

When letters are unassigned and reassigned due to backtracking, the savings is also substantial. It depends on the average number of letters remaining in each of the intersecting wordslots when backtracking occurs.

The invention includes yet another way of increasing the speed of flexibility analyses. This method can work with either sectioned or nonsectioned word lists, on a word size by word size basis, as desired. The method is that each flexibility analysis of a word fragment should also generate a "fitlist." A fitlist is a lists of words that did not conflict with the word fragment under analysis. The fitlist is saved in memory and is associated with the word fragment and wordslot that were analyzed. When another cell in that wordslot is assigned, another analysis needs to be done, and only the fitlist needs to be scanned. Scanning a fitlist is the logical equivalent of scanning the entire lexicon word list, and the resulting flexibility data are always the same, but it takes much less time. Subsequent assignments generate shorter and shorter fitlists. At some point, it is not worth generating another fitlist because the one being scanned is very short or only a few letters remain unassigned in the word fragment.

If fitlists are generated from sectioned word lists, some savings from sectioning is obtained in the first scan that generates the first fitlist. The resulting fitlists may or may not be sectioned also. Scanning a fitlists is already more efficient than scanning a sectioned word list. The additional savings obtained by sectioning the fitlists might not always justify the additional overhead.

The creation of fitlists does not slow scanning very much. First, it is necessary to find a place in memory where the new fitlist may be stored. When a pointer to this spot is ready, scanning may proceed. During scanning, every time a lexicon word is found to be nonconflicting, as defined above, the packed code for that lexicon word is copied to the location indicated by the fitlist pointer. The fitlist pointer is then incremented to point to the next available byte.

Sectioned fitlists can be created with the additional step of inserting section headers. During the scan, whenever a new section is started, the section ID and a section size of zero is inserted into the fitlist under creation. If none of the words in that section are nonconflicting, then the next section header should overwrite the unused section header. As nonconflicting words are found and added to the fitlist under creation, the section size should be incremented. The final section header should have a size of zero. (There is no need to combine multiple pseudo sections that represent one real section just because the words number few enough to be represented with one section size field.)

Fitlists require memory in unpredictable amounts and for unpredictable durations, thus they present some memory management concerns. To avoid memory fragmentation, fitlists that are expected to be relatively long should not be mixed with fitlists that are going to be tiny. Otherwise, a point may be reached where there is no single large-enough section of memory available because lots of little fitlists are scattered all over the place with medium sized gaps between them. Moving fitlists is a possibility, but takes valuable time. There are many ways around this problem. One way is to have a huge amount of memory available. Another way is to statically allocate various sized arrays for fitlists and use these arrays over and over, but always for fitlists that are expected to be of the appropriate size for the array. For these two ways, it is important that the destination in memory for a new fitlist be large enough to hold the new fitlist.

A third, preferred way is to implement fitlists as linked lists with each link having a certain maximum of number of words (e.g., 30 words). Fitlists longer than this number of words are continued in another link. This third way slows fitlist creation a little. It is implemented by testing the fitlist pointer after every new word to see if it is time to start a new link. On some computers, treating the link as an array and only incrementing an index into the array is faster than incrementing a pointer. This method involves the management of a pool of links. Sometimes the links of old fitlists might have to be taken to create a new fitlist. When this happens, the entire old fitlist should be invalidated (released) and all its links released into the pool of available links.

Fitlists can be retained in one of two ways. First, each WORD record 123 can be given one or more additional pointers that point to the series of shorter and shorter fitlists generated by subsequent assignments in the wordslot. Second, if a cache of flexibility analysis results is implemented, every request for a flexibility analysis first checks if there is a cache hit. Pointers to fitlists could be added to this cache, cataloging the fitlists by word fragment. This would create two kinds of cache hits: (1) found flexibility records and (2) found fitlist.

Because the possibility of backtracking is ever-present until construction is completed, old fitlists that were generated when there was a choice of letter election should be retained for until the area of activity on the puzzle grid has moved elsewhere. When there is no more memory, the least likely to be used again should be released for reuse. The least likely are those for cells that have been assigned long ago. A mistake here is no tragedy. Whenever a fitlist is released, the pointer in the WORD record 123 that pointed to that fitlist should be set to null to indicate that it is no longer available, or the cache entry deleted. If that wordslot or word fragment is ever involved in another flexibility analysis, it still can be done directly from the lexicon word list.

The invention constructs puzzles whether forced assignments are assigned one at a time or as a group. The method disclosed in the appendix is to do forced assignments one at a time, with each followed by down and across flexibility analyses. However, the preferred way is to assign all known forced assignments as a group with many flexibility analyses to follow. Often, the group will be the remainder of a word, so group assignment saves doing several redundant flexibility analyses on that word's wordslot.

When doing multiple flexibility analyses associated with a group of assignments, it is not necessary to continue the flexibility analyses once a contraindication has been discovered (i.e., an empty cell for which no letter can be assigned). The remaining flexibility analyses are irrelevant because it is already known that backtracking is required. If backtracking is required, forced assignments that were assigned as a group should be unassigned as a group.

The LIFO backtrack policy method is preferred because it prevents formation of an actual endless loop. By itself, it does not prevent the formation of impractically long and inefficient loops. That is the job of a good method of choosing the next cell to assign (i.e., the choice of cell policy). LIFO backtracking also identifies the moment that every possible attempt has been made. In spite of these advantages, it is not the only way to do it. Certain exceptions to the LIFO policy are particularly interesting or advantageous.

One exception to the LIFO assignment and backtrack policy method is that it is only necessary to do it on a local basis. The construction engine could be made to work with simultaneous multiple areas of activity (clusters), if these are treated as independent processes when it is necessary to undo assignments. That is, if one area of activity (cluster) gets stuck (reaches a contraindication), assignments from that area of activity are undone to get unstuck. It usually does not help to undo assignments in another area of activity. Cells distant from the stuck area can remain as is and only cells that are near the stuck area should be undone.

Another exception to the LIFO policy is that it is not always necessary to undo cells in the reverse order that they were assigned. It is preferred to do it according to the LIFO method because this is a conceptually logical way to step through the process. However, when an area of activity is stuck, it is only preferred and not essential to backtrack in a LIFO manner. Actually, any nearby cell whose assignment is contributing to the problem of being stuck can be unassigned to resolve the problem. Of course, the process should avoid disturbing fixed-position theme words and letters.

The ability to make exceptions to the LIFO policy would be especially useful for when one area of activity gradually moves over and has to merge into a group of cells that were assigned long ago. The current and old groups could be blended best if some cells of the old group could be changed without having to unravel everything that was done since they were first assigned. Keeping track of the status of each cell, whether it is part of a theme word, which letters of its set of possibilities are still untested, and the order in which the cells were assigned, should all help in freeing up some old cells in a logical manner, to continue onward on a cell by cell basis.

The appendix contains source code to a version of the process that works but does not contain any of the improvements taught herein. It is intended to be supplemental to the disclosure herein. If there appear to be any contradictions between the documentation internal to the appendix and the rest of the specification, the rest of the specification is controlling.

The foregoing description is given by way of illustration and example. In light of this teaching, many variations and modifications will become apparent to those familiar with the art without departing from the scope and spirit of the invention. Therefore, it is intended that the scope of this invention not be limited by the foregoing description but rather by the claims appended hereto.

I claim:

1. A method for constructing an unsolved crossword puzzle in an electronic computer having processor means, memory means for storing data, input means and output means, said method comprising:

(a) establishing in said memory means a crossword puzzle grid structure representing a two-dimensional array of cells, each of said cells being variables that contain data representing either a blocked state or an unblocked state of said cell, and each of said cells, when representing said unblocked state, additionally representing an unassigned state or an assigned state of said cell, and each of said cells, when representing an assigned state, also representing a letter of the alphabet;

(b) establishing in said crossword puzzle grid in said memory means a crossword puzzle pattern, said crossword puzzle pattern comprising a majority of unblocked cells, a minority of blocked cells, and a plurality of wordslots, each of said wordslots comprising an one-dimensional array of at least two mutually-adjacent unblocked cells, some of said wordslots oriented across and some of said wordslots oriented down in an intersecting network of wordslots, and wherein most to all unblocked cells are in intersecting wordslots;

(c) providing in said memory means a lexicon of words;

(d) said computer analyzing each wordslot that includes at least one unassigned cell in light of said assignments and said lexicon to determine, for each unassigned cell in said puzzle, a set of letters that are assignable to that unassigned cell, a letter being assignable to that unassigned cell if it does not rule out all the words in said lexicon from completing a wordslot that intersects at that unassigned cell;

(e) said computer attempting to fill said wordslots with words from said lexicon by following the steps comprising:

(1) said computer selecting an unassigned cell;

(2) said computer selecting a letter from the set of letters that are assignable to the cell selected in step (1);

(3) said computer assigning the letter selected in step (2) to the cell in step (1);

(4) said computer analyzing each wordslot that was altered by any of the steps (3), (5) and (6), to update for each unassigned cell in said wordslot, the set of letters that are assignable to that unassigned cell, a letter being assignable to that unassigned cell if it, together with any existing assignments, does not rule out all the words in said lexicon from completing a wordslot that intersects at that unassigned cell;

(5) whenever said computer updating a set of assignable letters results in an empty set of assignable letters, said computer reversing a sufficient number of assignments to restore the set of assignable letters to a non-empty condition;

(6) whenever said computer updating a set of assignable letters results in a set of assignable letters that contains only one letter, said computer forcing the assignment of that one letter and repeating step (4);

(7) said computer repeating steps (1), (2), (3), (4), (5) and (6) until all unassigned cells have become assigned cells or all selections have been attempted and the puzzle cannot be constructed.

2. The method of claim 1 wherein each of said wordslots comprises an one-dimensional array of at least three mutually-adjacent unblocked cells.

3. The method of claim 1 wherein all of said unblocked cells are in intersecting wordslots.

4. The method of claim 3 wherein each of said wordslots comprises an one-dimensional array of at least three mutually-adjacent unblocked cells.

5. The method of claim 1 additionally comprising the steps of:

providing in said memory means a plurality of floating theme words;

prior to said assigning in step (3), said computer searching said plurality of word slots and said plurality of floating theme words for one of said floating theme words that can be assigned to one of said word slots and, upon finding one of said floating theme words that can be assigned to one of said word slots, assigning latter-said floating theme word to latter-said word slot.

6. The method of claim 1 further comprising the steps of:

Prior to step (e), providing in said memory means a plurality of mandatory theme words;

prior to step (e), said computer assigning said plurality of mandatory theme words to said word slots in a balanced arrangement; and whenever said computer determines that all selections have been attempted and said unsolved crossword puzzle cannot be constructed, reassigning said plurality of mandatory theme words to said word slots in another balanced arrangement and repeating step (e).

7. The method of claim 1 wherein said crossword puzzle grid structure representing a two-dimensional array of cells has dimensions of fifteen by fifteen cells.

* * * * *